US010056040B2

(12) United States Patent
Nakakita et al.

(10) Patent No.: US 10,056,040 B2
(45) Date of Patent: Aug. 21, 2018

(54) DISPLAY APPARATUS AND DISPLAY METHOD

(71) Applicant: JOLED INC., Tokyo (JP)

(72) Inventors: Tomoki Nakakita, Tokyo (JP); Hiroshi Takahara, Osaka (JP)

(73) Assignee: JOLED INC., Tokyo (JP)

( * ) Notice: Subject to any disclaimer, the term of this patent is extended or adjusted under 35 U.S.C. 154(b) by 259 days.

(21) Appl. No.: 15/109,896

(22) PCT Filed: Dec. 24, 2014

(86) PCT No.: PCT/JP2014/006434
§ 371 (c)(1),
(2) Date: Jul. 6, 2016

(87) PCT Pub. No.: WO2015/104777
PCT Pub. Date: Jul. 16, 2015

(65) Prior Publication Data

US 2016/0358531 A1 Dec. 8, 2016

(30) Foreign Application Priority Data

Jan. 9, 2014 (JP) ..... 2014-002343

(51) Int. Cl.
*G09G 3/3266* (2016.01)
*G09G 3/20* (2006.01)
*G09G 3/3233* (2016.01)

(52) U.S. Cl.
CPC ..... *G09G 3/3266* (2013.01); *G09G 3/2022* (2013.01); *G09G 3/3233* (2013.01); (Continued)

(58) Field of Classification Search
CPC .. G09G 3/32–3/329; G09G 2310/0202; G09G 2310/0213
See application file for complete search history.

(56) References Cited

U.S. PATENT DOCUMENTS 9,640,104 B2 * 5/2017 Yamazaki ..... G09G 3/2007
9,928,781 B2 * 3/2018 Kamiyamaguchi .. G09G 3/3291
(Continued)

FOREIGN PATENT DOCUMENTS

JP 63-262688 10/1988
JP 2000-003155 1/2000
(Continued)

OTHER PUBLICATIONS

International Search Report (ISR) from International Searching Authority (Japan Patent Office) in International Pat. Appl. No. PCT/JP2014/006434, dated Mar. 31, 2015.

*Primary Examiner* — Patrick F Marinelli
(74) *Attorney, Agent, or Firm* — Greenblum & Bernstein, P.L.C.

(57) ABSTRACT

A display apparatus includes: display pixels arranged in rows and columns, each display pixel being disposed at the intersection of one of gate signal lines arranged in rows and one of source signal lines arranged in columns; a gate driver IC capable of selecting the gate signal lines based on a designated order; a source driver IC that outputs a voltage signal to the source signal lines; and a TCON. The display pixels each include an organic EL element, a capacitor into which the voltage signal is written, a capacitor capable of receiving an electric charge in the capacitor, and a driving transistor that supplies a driving current corresponding to the magnitude of the electric charge in the capacitor to the organic EL element. The TCON sorts the order of writing to the rows so as to reduce the difference in the voltage signal between successive rows.

8 Claims, 27 Drawing Sheets

(52) U.S. Cl.
CPC ..... *G09G 2300/0852* (2013.01); *G09G 2300/0861* (2013.01); *G09G 2310/0213* (2013.01); *G09G 2310/0262* (2013.01); *G09G 2330/045* (2013.01); *G09G 2360/16* (2013.01)

(56) References Cited

U.S. PATENT DOCUMENTS

| | | | | |
|---|---|---|---|---|
| 2007/0120868 | A1 | 5/2007 | Baek | |
| 2012/0327108 | A1* | 12/2012 | Kato | G09G 3/3233 345/619 |
| 2014/0292741 | A1 | 10/2014 | Yamazaki et al. | |
| 2014/0327664 | A1* | 11/2014 | Kanda | G09G 3/3233 345/212 |
| 2014/0375622 | A1* | 12/2014 | Nakagawa | G09G 3/3614 345/212 |
| 2016/0343305 | A1* | 11/2016 | Kamiyamaguchi | G09G 3/3241 |
| 2016/0358531 | A1* | 12/2016 | Nakakita | G09G 3/3233 |

FOREIGN PATENT DOCUMENTS

| | | |
|---|---|---|
| JP | 2000-010517 | 1/2000 |
| JP | 2005-055487 | 3/2005 |
| JP | 2006-023515 | 1/2006 |
| JP | 2007-148400 | 6/2007 |
| JP | 2008-249744 | 10/2008 |
| JP | 5378613 | 10/2013 |
| JP | 2014-209209 | 11/2014 |
| JP | 2014-219440 | 11/2014 |
| WO | 2010/106661 | 9/2010 |
| WO | 2013/118323 | 8/2013 |

* cited by examiner

FIG. 3

| | Item | Power (W) | | Remarks (conditions, etc.) |
|---|---|---|---|---|
| 1 | Signal line charge/discharge power (Ps) | 2.0 | 2.22 | $p = CV^2F$ |
| 2 | Analog system power (Pa) | 0.2 | | |
| 3 | Gamma unit power (Pg) | 0.02 | | |

FIG. 9

| | | | | | | |
|---|---|---|---|---|---|---|
| | | | | ... | | |
| | | | | ... | | |
| | | | | ... | | |
| | | | | ... | | |
| | | | | ... | | |
| | | | | ... | | |
| | | | | ... | | |
| | | | | ... | | |
| | | | | ... | | |
| | | | | ... | | |
| | | | | ... | | |

| Total voltage value (Total of squared voltage values) | Order of writing 1 (Before sorting) | Order of writing 2 (After sorting) |
|---|---|---|
| 23 | 1 | 10 |
| 17 | 2 | 7 |
| 1 | 3 | 1 |
| 5 | 4 | 4 |
| 19 | 5 | 9 |
| 2 | 6 | 2 |
| 15 | 7 | 6 |
| 29 | 8 | 11 |
| 7 | 9 | 5 |
| 18 | 10 | 8 |
| 2 | 11 | 3 |

Frame 1

Frame 2

DISPLAY APPARATUS AND DISPLAY METHOD

TECHNICAL FIELD

The present disclosure relates to a display apparatus and a display method, and more particularly to a display apparatus and a display method that use an organic electroluminescent (EL) element.

BACKGROUND ART

As a display apparatus that uses a current-driven light emitting element, an organic EL display that uses an organic electroluminescent element (hereinafter, referred to as "organic EL element") is known. Such an organic EL display is advantageous in that it has good viewing angle characteristics and a low power consumption.

An organic EL display includes a plurality of scanning lines (a plurality of gate signal lines), a plurality of signal lines (a plurality of source signal lines), a plurality of display pixels, a driving circuit and the like. Each of the plurality of display pixels is disposed at the intersection of a gate signal line and a source signal line, and includes a switching element, a capacitive element (capacitor), a driving transistor, an organic EL element and the like (see, for example, Patent Literatures (PTLs) 1 and 2).

In the organic EL display, in order to control the emission luminance of selected pixels, a source driver IC (circuit) that outputs an image signal and the like is disposed. The source driver IC (circuit) applies the image signal to the source signal lines. Also, in the organic EL display, in order to control the light emission timing of the selected pixels, an on-voltage or an off-voltage is applied to the gate signal lines connected to the selected pixels. In recent years, there is a trend for organic EL displays having a higher resolution and a larger screen.

CITATION LIST

Patent literatures

[PTL 1]
Japanese Unexamined Patent Application Publication No. 2000-010517
[PTL 2]
Japanese Unexamined Patent Application Publication No. 2007-148400

SUMMARY OF INVENTION

Technical Problem

However, organic EL displays including a higher-resolution display panel with a larger-size screen have a tendency to a have a larger load capacity on the source signal lines and a higher writing speed. When the load capacity on the source signal lines is large and the writing speed is high, the amount of heat generated from the source driver IC (circuit) (Integrated Circuit) that drives the source signal lines increases. There is a problem in that, if it is known in advance that the amount of heat generation will exceed the heat resistance performance of the source driver IC, it is necessary to provide a heat dissipation mechanism in order to prevent the source driver IC from damage. There is also another problem in that the heat generated from the source driver IC is transferred to the display region of the EL display panel and degrades the EL elements serving as pixels. Inclusion of a large heat dissipation mechanism increases the thickness of the panel module, and thus a feature of the EL display panel (EL display) being thin cannot be attained.

To address the above-described problems, the present disclosure provides a display apparatus and a display method in which the amount of heat generation can be reduced without lowering the image quality, a heat dissipation mechanism can be omitted or eliminated, and a thin panel module can be constructed.

Solution to Problem

A display apparatus according to one aspect of the present disclosure includes: a display unit including a plurality of gate signal lines arranged in rows, a plurality of source signal lines arranged in columns, and a plurality of display pixels disposed at intersections of the plurality of gate signal lines and the plurality of source signal lines; a gate driver capable of selecting the plurality of gate signal lines based on a designated order; a source driver that outputs a voltage signal to each of the plurality of source signal lines; and a control unit configured to control the plurality of display pixels, the gate driver and the source driver, wherein each of the plurality of display pixels includes: a light emitting element that emits light according to a driving current; a write capacitor into which the voltage signal is written; a display capacitor capable of receiving an electric charge of the write capacitor; and a driving transistor that supplies, to the light emitting element, the driving current corresponding to a magnitude of the electric charge stored in the display capacitor, each of the plurality of display pixels being capable of independently executing writing of the voltage signal into the write capacitor and light emission of the light emitting element according to the electric charge stored in the display capacitor, the control unit is configured to execute sort processing of sorting an order of writing to the rows of the display unit so as to reduce a difference in the voltage signal between two successive rows in the order of writing, and the control unit is configured to designate the order of writing so as to cause the gate driver to select the plurality of gate signal lines based on the order of writing after the sort processing has been executed by the control unit.

Advantageous Effects of Invention

With the display apparatus and the display method according to the present disclosure, the amount of heat generation can be reduced without lowering the image quality, a heat dissipation mechanism can be omitted or eliminated, and a thin panel module can be constructed.

BRIEF DESCRIPTION OF DRAWINGS

FIG. 3 is a table showing an example of electric power during charge and discharge of the organic EL display according to the comparative example.

FIG. 9 is a diagram showing an example of a frame according to the embodiment.

DESCRIPTION OF EMBODIMENTS (Details of Problem)

As described above, organic EL displays including a display panel with a larger-size screen such as a 40-inch screen or above have a tendency to have a larger load capacity on the source signal lines and a large amount of heat generation. Also, in organic EL displays including a higher-resolution display panel such as a 4K2K panel (a panel having 4K×2K pixels or more) or a 8K4K panel, the selection period for one pixel row becomes shorter, and the rate of change (frequency) of the image signal output from the source driver IC becomes higher, as a result of which the amount of heat generated from the source driver IC increases. The output power of the source driver IC is proportional to a frequency F calculated using a load capacity C on source signal lines, a squared voltage difference V of image amplitude voltage and a selection period for one pixel row.

A relationship between the load capacity C on source signal lines and the amount of heat generation in the organic EL display described above will be described.

[Configuration of Organic EL Display of Comparative Example]

Figure 1A:
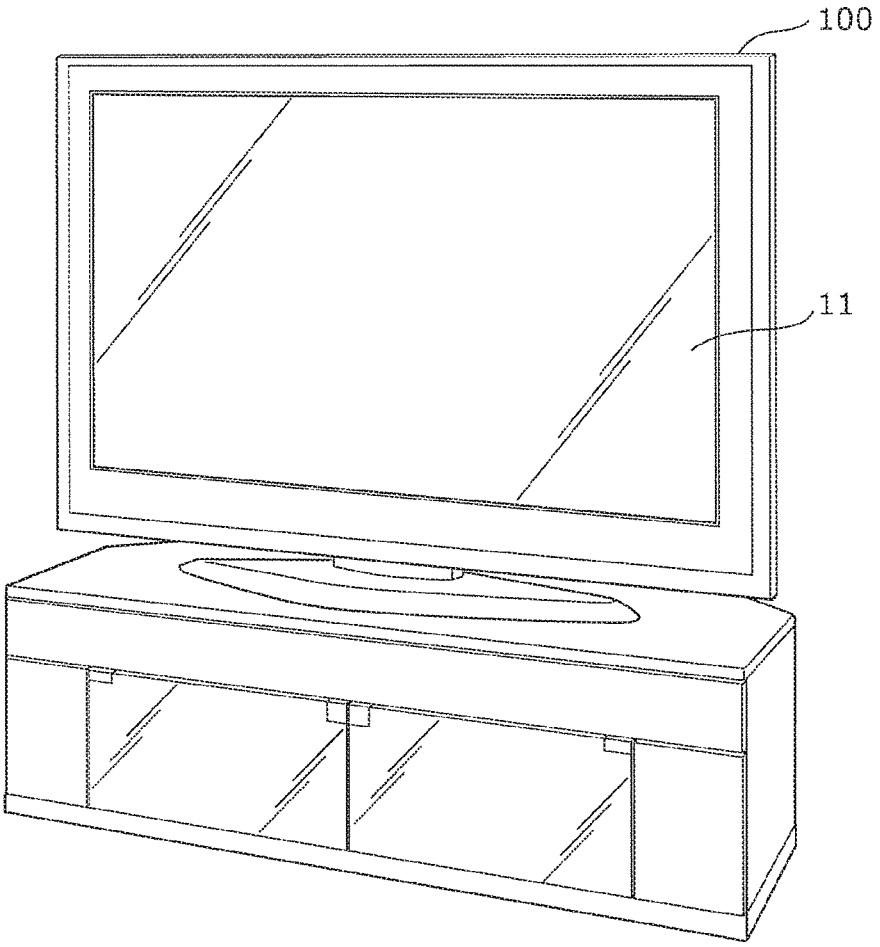
FIG. 1A is an external view showing an example of an outer appearance of an organic EL display.
Figure 1B:
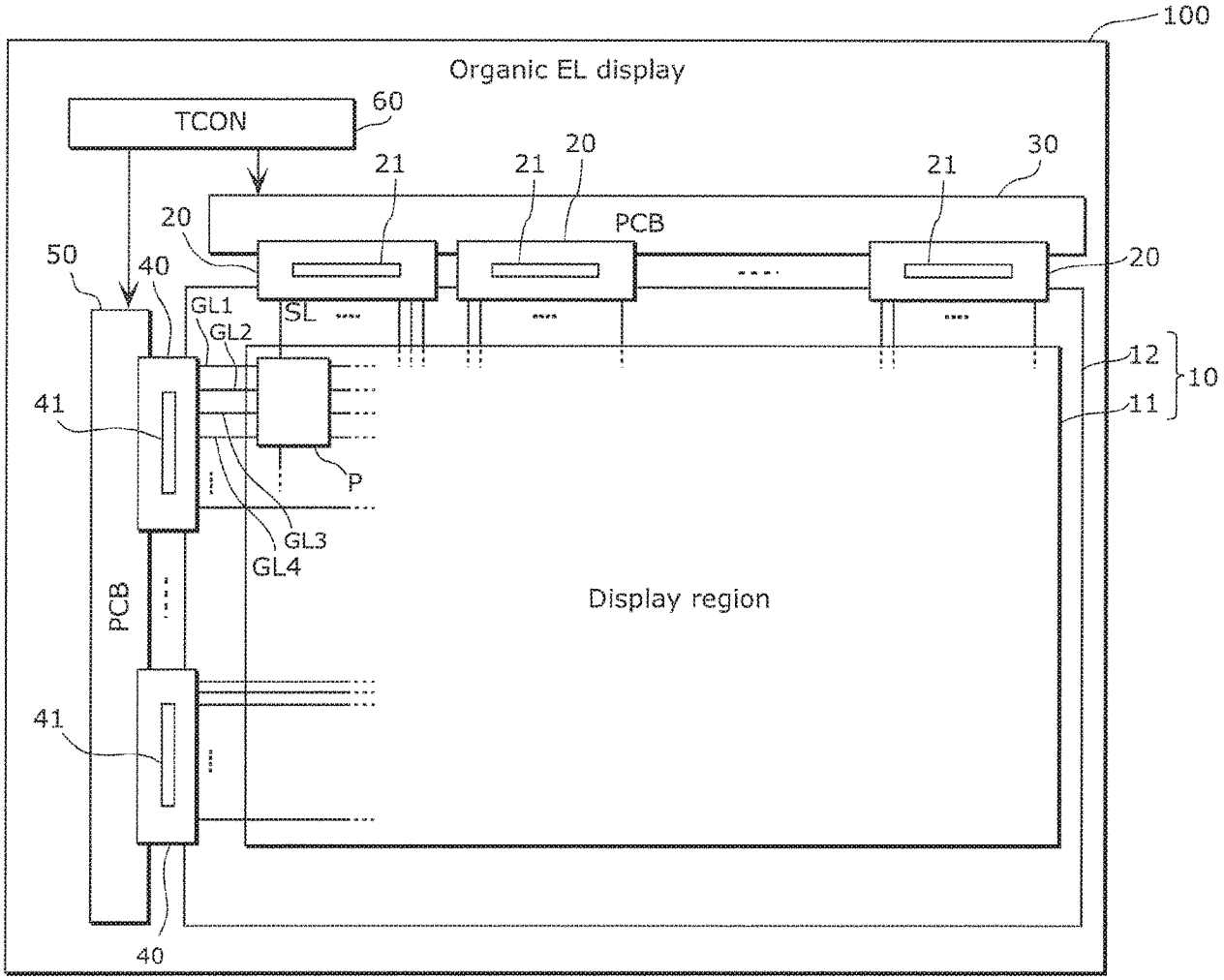
FIG. 1B is a block diagram showing an example of a configuration of an organic EL display.

First, a configuration of an organic EL display according to a comparative example will be described with reference to FIGS. 1A to 3. FIG. 1A is an external view showing an example of an outer appearance of an organic EL display. FIG. 1B is a block diagram showing an example of a configuration of an organic EL display.

In an image display apparatus according to the comparative example, EL elements of three primary colors: red (R), green (G) and blue (B) are formed in a matrix.

Color filters of red (R), green (G) and blue (B) may be formed so as to correspond to the positions of pixels. The colors of the color filters are not limited to R, G and B, and it is also possible to form pixels of cyan (C), magenta (M) and yellow (Y). It is also possible to form white (W) pixels. In other words, R, G, B and W pixels are arranged in a matrix on a display screen.

The R, G and B pixels may have different aperture ratios. As a result of the R, G and B pixels having different aperture ratios, the EL elements of R, G and B can have different current densities flowing therethrough. As a result of the R, G and B pixels having different current densities, the EL elements of R, G and B can have the same degradation rate. As a result of the R, G and B pixels having the same degradation rate, white balance shifts do not occur in the image display apparatus.

Also, if necessary, white (W) pixels are formed. In other words, the pixels are composed of R, G, B and W pixels. As a result of the pixels being composed of R, G, B and W pixels, the luminance can be increased. The pixels may be composed of R, G, B and G pixels.

The image display apparatus is colorized by mask deposition, but the embodiment is not limited thereto. It is also possible to, for example, form a blue light-emitting EL layer, and convert the emitted blue light into R, G and B light rays by R, G and B color conversion layers (CCM: color change media).

On the light emission surface of the image display apparatus, a circular polarization plate (circular polarization film) (not shown) may be disposed. A combination of a polarization plate and a phase film is called a "circular polarization plate (circular polarization film)".

As shown in FIG. 1B, an organic EL display 100 includes an organic EL panel 10, a source driver IC 20, a PCB (Printed Circuit Board) 30, a gate driver IC 40, a PCB 50, and a TCON (timing controller) 60.

The organic EL panel 10 includes a display region 11 and a glass substrate 12, the display region 11 including a plurality of gate signal lines GL arranged in rows, a plurality of source signal lines SL arranged in columns, and a plurality of display pixels P arranged in rows and columns, each display pixel P being disposed at the intersection of a gate signal line GL and a source signal line SL, and the glass substrate 12 including wiring (the gate signal lines CL and the source signal lines SL) connecting the display region 11 to the PCB 30 and the PCB 50.

The display region 11 is a region for displaying an image, and the plurality of display pixels P are disposed at a position that can be viewed by a user.

Although not shown in the diagrams, each display pixel P includes an organic EL element that emits light according to the electric current supplied thereto, a driving transistor that supplies, to the organic EL element, a driving current corresponding to the magnitude of a voltage signal (the voltage of the source signal line SL), a switching element that performs switching between selection and deselection of the display pixel P, a capacitor into which the voltage signal is written, and the like.

Figure 5:
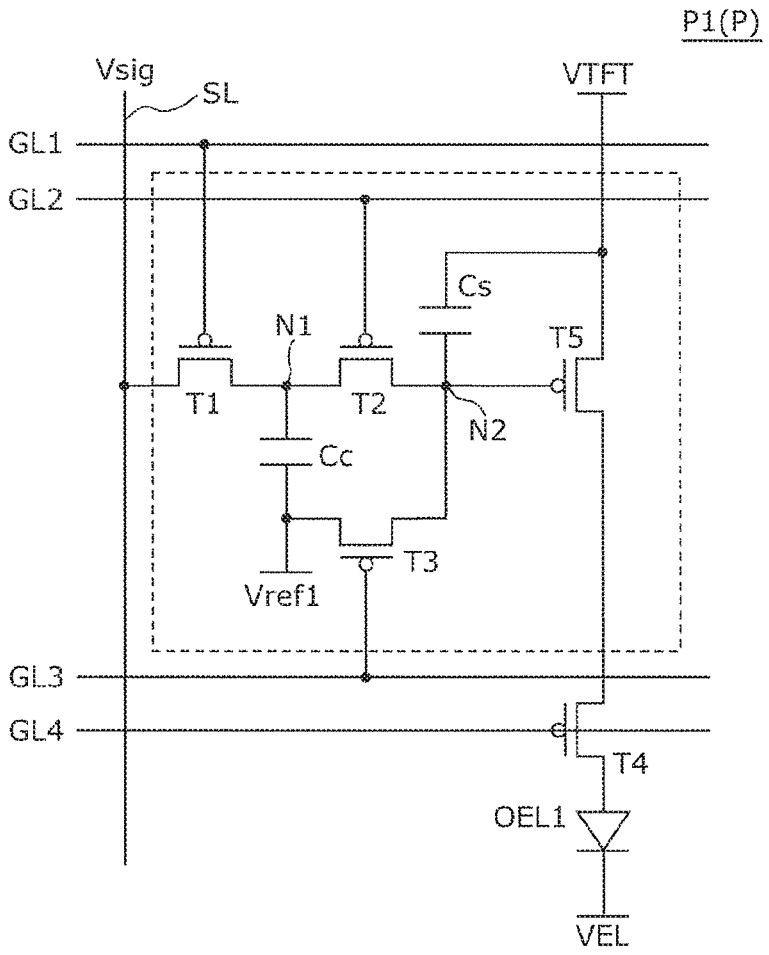
FIG. 5 is a circuit diagram showing an example of a configuration of a display pixel according to an embodiment.

As shown in FIG. 5, which will be described later, the pixel included in the EL display apparatus according to the comparative example includes transistors, capacitors, an EL element, and the like. The transistors including a driving transistor T5 and switching elements will be described as thin film transistors (TFT), but the embodiment is not limited thereto. It is possible to use FET, MOS-FET, MOS transistors, or bipolar transistors. They are also basically thin film transistors. It will also be appreciated that, other than the above, it is also possible to use varistors, thyristors, ring diodes, photodiodes, phototransistors, PLZT elements or the like.

Also, the embodiment is not limited to the use of thin film elements, and it is also possible to use transistors formed on a silicon wafer. For example, it is possible to use transistors formed using a silicon wafer, and separated and transferred onto a glass substrate. It is also possible to use a display panel in which transistor chips are formed using a silicon wafer and mounted on a glass substrate by bonding.

It is preferable that the transistors have a LDD (Lightly Doped Drain) structure regardless of whether they are n-type or p-type.

Also, the transistors may be made using any one of high-temperature polysilicon (HTPS), low-temperature polysilicon (LTPS), continuous grain silicon (CGS), transparent amorphous oxide semiconductor (TAOS), amorphous silicon (AS), rapid thermal annealing (RTA).

In FIG. 5, all of the transistors constituting a pixel are p-type transistors. However, the embodiment is not limited to the configuration in which the transistors constituting a pixel are p-type transistors. The transistors may be n-type transistors. It is also possible to use both n-type and p-type transistors.

A switching element T1 is not limited to a transistor, and may be, for example, an analog switch formed by using both a p-type transistor and an n-type transistor.

The transistor is preferably configured to have a top gate structure. The reason is that as a result of having a top gate structure, the parasitic capacitance is reduced, the gate electrode pattern of the top gate structure can serve as a light shielding layer, and the light emitted from the EL element can be shielded by the light shielding layer, as a result of which the malfunction of the transistor and off-leakage current can be reduced.

It is preferable to carry out a process that allows the use of copper wiring or copper alloy wiring as the gate signal lines, the source signal lines or both the gate signal lines and the source signal lines. The reason is that the line resistance of the signal lines can be reduced, and a larger EL display panel can be implemented.

It is preferable that the gate signal lines driven (controlled) by the gate driver IC (circuit) are configured to have a low impedance. Accordingly, the same applies to the configuration or structure of the source signal line.

In particular, it is preferable to use low-temperature polysilicon (LTPS). With the use of low-temperature polysilicon, as the transistors, it is possible to produce n-type and p-type transistors having a top gate structure and a small parasitic capacitance. Also, as the process, a process that allows the use of copper wiring or copper alloy wiring can be used. The copper wiring preferably has a three-layer structure of Ti—Cu—Ti.

In the case where the transistors are made of a transparent amorphous oxide semiconductor (TAOS), the wiring such as the gate signal lines or the source signal lines preferably have a three-layer structure of molybdenum (Mo)—Cu—Mo.

The capacitors are formed or disposed so as to overlap (overlay) at least one of the source signal lines or the gate signal lines. In this case, the degree of freedom of layout can be enhanced, and a wider space can be secured between elements. As a result, the yield is improved.

An insulation film or an insulation film made of acrylic material (planarization film) is formed on the source signal lines and the gate signal lines to provide insulation, and pixel electrodes are formed on the insulation film.

The display pixels P correspond to any one of three primary colors of R (red), G (green) and B (blue). A set of three display pixels P of R, G and B constitute one pixel. A plurality of display pixels P constituting the same pixel are disposed adjacent to each other.

In the present embodiment, the source driver IC 20 is composed of a COF (Chip on Film, Chip on Flexible) in which source signal line driving circuits 21 are mounted on a flexible cable.

The source signal line driving circuits 21 apply, to the source signal lines SL, a voltage corresponding to the voltage signal from the TCON 60.

In the present embodiment, the gate driver IC 40 is composed of a COF in which gate signal line driving circuits 41 are mounted on a flexible cable. The gate signal line driving circuits 41 apply, to each of the gate signal lines GL, a voltage that turns a switching element connected to the gate signal line GL on or off according to a scan signal from the TCON 60.

[Relationship Between Load Capacity on Source Signal Lines and Amount of Heat Generation According to Comparative Example]

Figure 2:
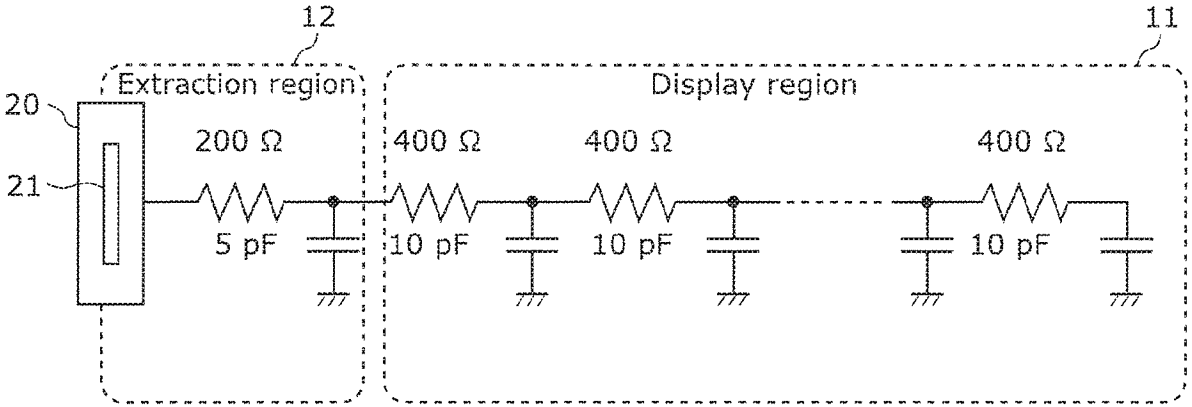
FIG. 2 is a diagram showing an example of the load capacity of a source signal line of an organic EL display according to a comparative example.

FIG. 2 is a diagram showing an example of load capacity in the organic EL panel 10. FIG. 3 is a table showing an example of electric power during charge and discharge according to the comparative example.

As shown in FIG. 3, the charging/discharging capability is determined by $CV^2F$. C represents the load capacity on source signal lines. V represents the voltage difference (potential difference) of output voltage. The voltage applied to a pixel corresponds to the emission luminance of the EL element. Accordingly, voltage difference V corresponds to a voltage difference between the voltage applied to the pixel previously written and the voltage applied to the pixel currently written. F represents the frequency of selected pixel rows. For example, if the frame frequency is 120 Hz, and the number of pixel rows is 2160, F=120×2160=approximately 260 kHz. As described above, organic EL displays that use a higher-resolution display panel have a tendency to have a larger load capacity C on the source signal lines and a higher writing speed (corresponding to F). Also, the charging/discharging capability is proportional to a squared voltage difference V, and thus the effect of the voltage difference V is large.

From FIGS. 2 and 3, the output power required for a commonly used source driver IC 20 is 2.22 W. Because a 8K4K panel includes twice as many pixel rows as the number of pixel rows of a 4K2K panel, if the frame rate is the same, the driving capability required for the source driver IC 20 in the 8K4K panel is twice that of the ordinary source driver IC 20, which amounts to approximately 4.5 W. Note that, however, in the 8K4K panel, the number of source signal lines is also twice that of the 4K2K panel, which requires twice the number of source drivers IC, and thus the overall power of the source driver IC is quadrupled, which means there is a double increase.

Figure 4:
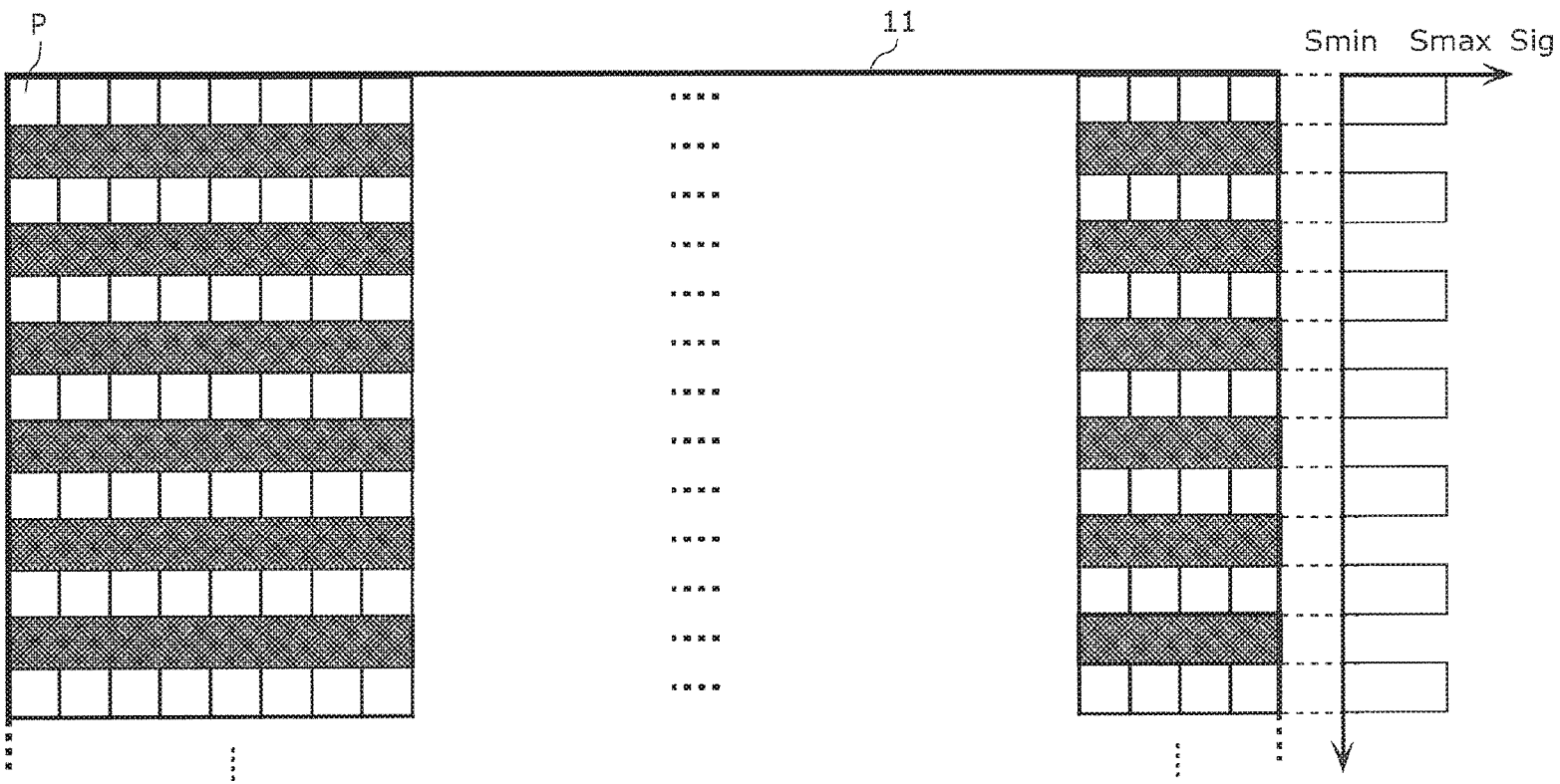
FIG. 4 is a diagram showing a relationship between the luminance values of the rows of an image and the output voltage of a source driver IC.

FIG. 4 is a diagram showing a relationship between the luminance values of the rows of an image and the output voltage of the source driver IC 20. On the left side of FIG. 4, an image displayed on a panel is schematically shown. FIG. 4 shows a monochrome horizontal stripe image in which white pixel rows, each pixel row including white pixels, and black pixel rows, each pixel row including black pixels, are alternately arranged. On the right side of FIG. 4, the output voltages of the source signal lines are shown. Smin represents the minimum gradation voltage (black), and Smax represents the maximum gradation voltage (white). In the graph shown on the right side of the diagram of FIG. 4, the horizontal axis indicates the output voltage of the source driver IC, and the vertical axis indicates time (+ in the downward direction). Accordingly, the vertical axis indicates the order of writing. Because the displayed image is a monochrome horizontal stripe image, the voltage output by the source driver IC varies alternately between the voltage corresponding to Smax and the voltage corresponding to Smin for each pixel row.

In the case where the pixel rows of white pixels having the maximum luminance value and the pixel rows of black pixels having the minimum luminance value are alternately arranged as shown in FIG. 4, the output voltage of the source driver IC 20 is maximized.

As illustrated in FIG. 4, because the voltage varies alternately between the maximum voltage and the minimum voltage for each pixel row, the potential difference V is maximized. Accordingly, the power per terminal of the source driver IC is maximized.

If the output voltage of the source driver IC 20 increases, the amount of heat generated from the source driver IC increases. An increased amount of heat generation may thermally damage the source driver IC 20, causing a possibility that a normal operation cannot be performed. Accordingly, it is necessary to include a heat dissipation mechanism for cooling the source driver IC. Inclusion of a heat dissipation mechanism increases the number of components required to perform heat dissipation in the organic EL display, creating a problem in that it is difficult to achieve a panel having a reduced thickness.

In order to solve the problems described above, a display apparatus according to one aspect of the present disclosure includes: a display unit including a plurality of gate signal lines arranged in rows, a plurality of source signal lines arranged in columns, and a plurality of display pixels disposed at intersections of the plurality of gate signal lines and the plurality of source signal lines; a gate driver capable of selecting the plurality of gate signal lines based on a designated order; a source driver that outputs a voltage signal to each of the plurality of source signal lines; and a control unit configured to control the plurality of display pixels, the gate driver and the source driver, wherein each of the plurality of display pixels includes: a light emitting element that emits light according to a driving current; a write capacitor into which the voltage signal is written; a display capacitor capable of receiving an electric charge of the write capacitor; and a driving transistor that supplies, to the light emitting element, the driving current corresponding to a magnitude of the electric charge stored in the display capacitor, each of the plurality of display pixels being capable of independently executing writing of the voltage signal into the write capacitor and light emission of the light emitting element according to the electric charge stored in the display capacitor, the control unit is configured to execute sort processing of sorting an order of writing to the rows of the display unit so as to reduce a difference in the voltage signal between two successive rows in the order of writing, and the control unit is configured to designate the order of writing so as to cause the gate driver to select the plurality of gate signal lines based on the order of writing after the sort processing has been executed by the control unit.

As described above, the charging/discharging capability is determined by $CV^2F$, but the load capacity C and the frequency F of the source signal lines are determined to a certain degree by the specifications of the organic EL panel. With the display apparatus having the above-described configuration, the voltage difference (V) is suppressed by sorting the rows to be displayed, and thus the charging/discharging capability required for the source driver (also referred to as "source driver IC" where appropriate) can be minimized.

The embodiment according to the present disclosure will be described using the source driver IC, but the present disclosure is not limited to a source driver IC made of a semiconductor chip. For example, it is possible to use a transistor formed using a silicon wafer, and separated and transferred onto a glass substrate. It is also possible to use a display panel in which a transistor chip is formed using a silicon wafer and mounted on a glass substrate by bonding. It is also possible to form a source driver circuit directly on a glass substrate having pixels formed thereon, by using low-temperature polysilicon, high-temperature polycry silicon, a TAOS technique and the like.

Also, in the display apparatus having the above-described configuration, each display pixel includes a write capacitor and a display capacitor so that writing of the voltage signal and light emission of the light emitting element can be performed independently of each other, and it is therefore possible to cause a plurality of display pixels to emit light at the same timing. If writing of the voltage signal and light emission of the light emitting element cannot be performed independently of each other, the rows caused to emit light by the previous voltage signals and the rows caused to emit light by the current voltage signals are displayed in a mixed-up manner, which may lower the image quality. However, with the display apparatus having the above-described configuration, it is possible to prevent the rows caused to emit light by the previous voltage signals and the rows caused to emit light by the current voltage signals from being displayed in a mixed-up manner, and thus prevent the image quality from lowering.

For example, the control unit may be configured to, in the sort processing, calculate an index value indicating a brightness level of each of the rows of the plurality of display pixels, and sort the order of writing by using the index value. For example, the control unit may be configured to obtain, as the index value, a total value obtained by obtaining a squared voltage signal for each of the plurality of display pixels and summing the squared voltage signals for each row. For example, the control unit may be configured to, in the sort processing, sort the index value in descending order or in ascending order, and set the order of writing based on the order in which the index values were sorted. For example, the control unit may be configured to, in the sort processing, obtain minimum and maximum index values, which are minimum and maximum of the index value, in a current instance of the sort processing, compare a final index value, which is an index value of a last row in the order of writing in a previous instance of the sort processing with the minimum and maximum index values, sort the index value in ascending order when a difference between the final index value and the minimum index value is smaller than a difference between the final index value and the maximum index value, and sort the index value in descending order when the difference between the final index value and the maximum index value is smaller than the difference between the final index value and the minimum index value. For example, the control unit may be configured to, in the sort processing, execute first search processing of setting rows for which the order of writing has not been set as search target rows, sequentially searching the search target rows in one direction so as to retrieve rows by using a search condition that defines the rows having the index value whose difference with the index value of a last retrieved row is less than or equal to a threshold value, and setting the order of writing based on the order in which the rows were retrieved. For example, the control unit may be configured to, after execution of the first search processing, execute second search processing of further setting rows for which the order of writing has not been set as search target rows, searching the search target rows in the one direction so as to retrieve search target rows whose index value is greater or smaller than the index value of a last retrieved search target row, and setting the order of writing based on the order in which the search target rows were retrieved.

All of the configurations described above define the order of sorting. With any one of the sorting methods, it is possible to reduce the difference in voltage signal (image voltage signal) between two successive rows in the order of writing. It is thereby possible to reduce the output power of the source driver IC and effectively prevent the source driver IC from being thermally damaged. It is also possible to suppress a situation in which heat generated from the source driver is transferred to the display screen, and prevent the degradation of the EL elements of the display screen.

In the present disclosure, a voltage signal is used as the signal output from the source driver (voltage program scheme), but the present disclosure is not limited thereto. It is also possible to use, for example, a current signal (current program scheme). Even a current signal can be expressed as the amplitude of an image signal, and a current difference can be regarded as a voltage difference. By converting current difference I to voltage difference V, heat generation can be calculated by using $CV^2F$.

For example, each of the plurality of display pixels may further include: a first switch circuit that performs switching between selection and deselection of the each of the plurality of display pixels; a second switch circuit that performs switching between connection and disconnection between the write capacitor and the display capacitor; and a third switch circuit that performs switching between connection and disconnection between the driving transistor and the light emitting element. The gate driver may, in writing processing of writing the voltage signal, disconnect the second switch circuit so as to make the write capacitor and the display capacitor independent of each other, select the first switch circuit so as to write the voltage signal into the write capacitor, and connect the third switch circuit so as to cause the light emitting element to emit light, and in copy processing of copying the voltage signal from the write capacitor to the display capacitor, deselect the first switch circuit and disconnect the third switch circuit so as to cause the light emitting element to stop emitting light, and connect the second switch circuit so as to write the voltage signal written in the write capacitor into the display capacitor.

In order to solve the problems described above, a display method according to one aspect of the present disclosure is a display method executed in a display apparatus including: a display unit including a plurality of gate signal lines arranged in rows, a plurality of source signal lines arranged in columns, and a plurality of display pixels disposed at intersections of the plurality of gate signal lines and the plurality of source signal lines; a gate driver capable of selecting the plurality of gate signal lines based on a designated order; a source driver that outputs a voltage signal to each of the plurality of source signal lines; and a control unit configured to control the plurality of display pixels, the gate driver and the source driver, each of the plurality of display pixels including: a light emitting element that emits light according to a driving current; a write capacitor into which the voltage signal is written; a display capacitor capable of receiving an electric charge of the write capacitor; and a driving transistor that supplies, to the light emitting element, the driving current corresponding to a magnitude of the electric charge stored in the display capacitor, and being configured to be capable of independently executing writing of the voltage signal into the write capacitor and light emission of the light emitting element according to the electric charge stored in the display capacitor, the display method including: with the control unit, sorting an order of writing to the rows of the display unit so as to reduce a difference in the voltage signal between two successive rows in the order of writing; designating the order of writing so as to cause the gate driver to select the plurality of gate signal lines based on the order of writing after the sorting has been executed; controlling the each of the plurality of display pixels such that the display capacitor and the write capacitor are not electrically connected to each other when the plurality of gate signal lines are selected by the gate driver; and controlling the each of the plurality of display pixels such that the display capacitor and the write capacitor are electrically connected to each other when the plurality of gate signal lines are not selected by the gate driver.

The configuration described above defines a specific aspect for performing writing of the voltage signal and light emission of the light emitting element independently of each other. When the write capacitor and the display capacitor are disconnected by the second switch circuit, writing of the voltage signal and light emission of the light emitting element can be performed independently of each other.

When, on the other hand, the write capacitor and the display capacitor are connected by the second switch circuit, the voltage signal of the write capacitor can be copied to the display capacitor.

The generic or specific aspect may be implemented by a system, a method, an integrated circuit, a computer program or a computer readable recording medium such as a CD-ROM, or may be implemented by any combination of a system, a method, an integrated circuit, a computer program and a recording medium.

Hereinafter, embodiments according to the present disclosure will be described specifically with reference to the drawings. Note that, however, each of the embodiments described below shows a generic or specific example of the present disclosure. The numerical values, shapes, materials, structural elements, the arrangement and connection of the structural elements, steps, the order of the steps, etc. shown in the following embodiments are mere examples, and therefore do not limit the present disclosure. Also, among the structural elements in the following embodiments, structural elements not recited in any one of the independent claims are described as arbitrary structural elements.

Also, in order to facilitate the understanding, and also, in order to simplify the drawings, some portions in the drawings have been omitted, or enlarged or reduced in size. Also, the portions having the same reference numerals, signs and the like have the same or similar embodiment, material, function or operation, or a related feature, advantageous effect or the like.

(Embodiment)

A display apparatus according to an embodiment will be described with reference to FIGS. 5 to 15B.

The display apparatus according to the present embodiment sorts the order in which the gate signal lines are selected, so as to reduce the output power of the source driver IC. Furthermore, in order to prevent the lowering of the image quality caused by the order in which the gate signal lines are selected, a configuration is used that enables each display pixel to separately execute writing processing and display processing.

In the present embodiment, the display apparatus is an organic EL display.

[1-1. Configuration of Organic EL Display]

A configuration of the organic EL display according to the present embodiment will be described with reference to FIG. 1B and FIGS. 5 and 6.

The organic EL display according to the present embodiment has the same basic structure as that of the organic EL display 100 shown in FIG. 1B, and the organic EL display includes an organic EL panel 10, a source driver IC 20, a PCB 30, a gate driver IC 40, a PCB 50, and a TCON 60.

The organic EL panel 10 includes a display region 11 (corresponding to a display unit) and a glass substrate 12, the display region 11 including a plurality of gate signal lines GL arranged in rows, a plurality of source signal lines SL arranged in columns, and a plurality of display pixels P arranged in rows and columns, each display pixel being disposed at the intersection of a gate signal line GL and a source signal line SL, and the glass substrate 12 including wiring (the gate signal lines GL and the-source signal lines SL) connecting the display region 11 to the PCB 30.

The display region 11 is a region for displaying an image, and the plurality of display pixels P are disposed at a position that can be viewed by a user.

[1-1-1. Configuration of Display Pixel]

The display pixels P correspond to any one of three primary colors of R (red), G (green) and B (blue). A set of three display pixels P of R, G and B constitute one pixel. A plurality of display pixels P constituting the same pixel are disposed adjacent to each other.

The display pixels P according to the present embodiment are each configured so as to be capable of independently executing writing of the voltage signal and light emission of the organic EL element. With this configuration, even if the order in which the gate signal lines are selected is disordered in a single frame, the display can be switched simultaneously with all of the display pixels P. For this reason, in the organic EL display according to the present embodiment, a situation in which two frames are displayed in a mixed-up manner does not occur, and the lowering of the image quality can be prevented.

FIG. 5 is a circuit diagram showing an example of a configuration of a display pixel P1 (P) according to the present embodiment. As shown in FIG. 5, the display pixel P1 includes switching elements T1 to T4, capacitors Cc and Cs, a driving transistor T5 and an organic EL element (light emitting element) OEL1.

The switching element T1 is an example of a first switch circuit that performs switching between selection and deselection of the display pixel P1, and is composed of a P-channel type MOS transistor. The switching element T1 performs switching between conduction and non-conduction between the source signal line SL and a node N1 according to the selection signal applied to a gate signal line GL1.

The switching elements T2 to T4 are P-channel type MOS transistors. With the switching elements T2 to T4, a writing operation of writing the voltage signal into the capacitor Cc, a reset operation of resetting the capacitor Cs, a copy operation of copying the voltage signal written into the capacitor Cc to the capacitor Cs, and a light emitting operation of causing the organic EL element OEL1 to emit light can he performed. Details of these operations will be described later.

The switching element T2 is an example of a second switch circuit that performs switching between connection and disconnection between the capacitor Cc and the capacitor Cs, and performs switching between conduction and non-conduction between the node N1 and a node N2 according to the signal applied to a gate signal line GL2.

The switching element T3 switches whether or not to input a voltage Vref1 to the node N2 according to the signal applied to a gate signal line GL3. The voltage Vref1 is a voltage for initializing the capacitor Cs.

The switching element T4 is an example of a third switch circuit that performs switching between connection and disconnection between the driving transistor T5 and the organic EL element OEL1, and performs switching between supply and non-supply of a driving current to the organic EL element OEL1 by the driving transistor T5 according to the signal applied to a gate signal line GL4.

The driving transistor T5 is a P-channel type MOS transistor, and supplies, to the organic EL element OEL1, the driving current corresponding to the magnitude of the voltage signal written into the capacitor Cs. The driving transistor T5 has a gate terminal connected to the node N2, a drain terminal connected to the anode electrode of the organic EL element OEL1, and a source terminal that receives an input of anode voltage VTFT.

The organic EL element OEL1 is an element that emits light according to the driving current supplied from the driving transistor T5. In the organic EL element OEL1, its cathode electrode receives an input of cathode voltage VEL, and its anode electrode is connected to the switching element T4.

The capacitor Cc is an example of a write capacitor into which the voltage signal is written by the source driver IC 20, the capacitor having one end being connected to the node N1 and the other end receiving an input of reference voltage Vref1.

The capacitor Cs is an example of a display capacitor to which the voltage signal written in the capacitor Cc is copied (that receives the electric charge stored in the capacitor Cc), the capacitor having one end being connected to the node N2 and the other end receiving an input of voltage VTFT.

As a result of having the above-described configuration, the display pixel P1 can perform writing of the voltage signal and light emission of the organic EL element independently of each other. Detailed operations will be described later.

[1-1-2. Configuration of Source Driver IC]

In the present embodiment, the source driver IC 20 is composed of a COF in which source signal line driving circuits 21 are mounted on a flexible cable. The source signal line driving circuits 21 apply, to each source signal line SL, a voltage signal having a voltage value corresponding to the pixel value of the display pixel P1 connected to the source signal line SL, based on a data signal from the TCON 60. The PCB 30 is a printed board that connects the source driver IC 20 to the TCON 60.

[1-1-3. Configuration of Gate Driver IC]

In the present embodiment, the gate driver IC 40 is composed of a COF in which gate signal line driving circuits 41 are mounted on a flexible cable. The gate signal line driving circuits 41 apply, to gate signal lines GL selected by the TCON 60, a selection signal having a voltage value for turning on the switching elements (transistors) of the display pixel P1 connected to the gate signal lines GL. Also, the gate signal line driving circuits 41 apply, to each of (deselected) gate signal lines GL not selected by the TCON 60, a deselection signal having a voltage value for turning off the switching elements of the display pixel P1 connected to the gate signal line GL.

The gate driver IC 40 according to the present embodiment is configured so as to be capable of designating the gate signal lines to which the selection signal is applied in an arbitrary order.

Figure 6:
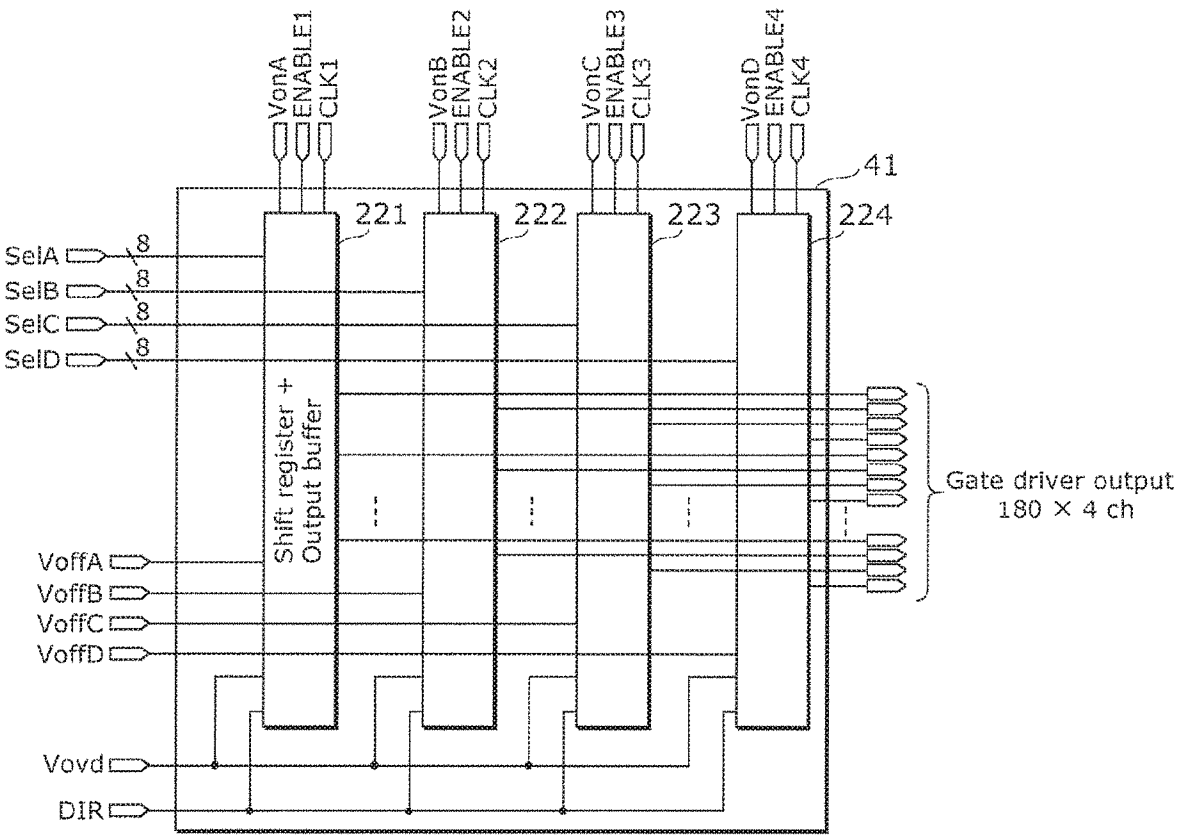
FIG. 6 is a block diagram showing an example of a configuration of a gate signal line driving circuit mounted on a gate driver IC according to the embodiment.

FIG. 6 is a block diagram showing an example of a gate signal line driving circuit 41 mounted on the gate driver IC 40. As shown in FIG. 6, the gate signal line driving circuit 41 includes four shift registers 221 to 224. The shift register 221 (i=1 to 4) receives an input of signal Selj (when i=1, j=A, and likewise, when i=2 to 4, j=B to D) indicating a selected gate signal line GL, a voltage Vonj for turning on the transistor, a voltage Voffj for turning off the transistors, Vovd, DIR for controlling the direction of signal, an enable signal ENABLEi, and a clock signal CLKi. The shift register 22*i* applies the voltage Vonj to a gate signal line GL designated from among 180 gate signal lines GL by the signal Selj, and applies the Voffj to the other gate signal lines GL.

The PCB 50 is a printed board that connects the gate driver IC 40 and the TCON 60.

[1-1-4. Configuration of TCON (Timing Controller)]

The TCON 60 is an example of a control unit that controls the display of an image on the display region 11.

Figure 25A:
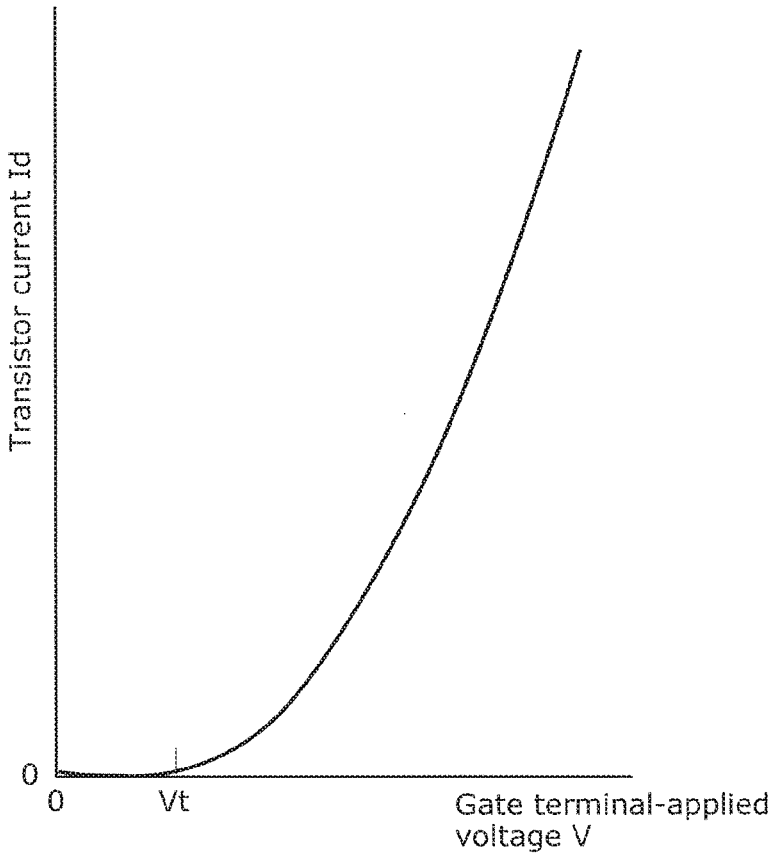
FIG. 25A is a graph showing the characteristics of a driving transistor.

FIG. 25A is a diagram showing a relationship between a gate terminal-applied voltage (=image signal voltage Vsig) that is applied to the gate terminal of the voltage driving transistor T5 and a current Id that flows through the driving transistor T5. The V-Id curve of the driving transistor T5 is a substantially squared curve with Vt being set to 0 point.

Figure 25B:
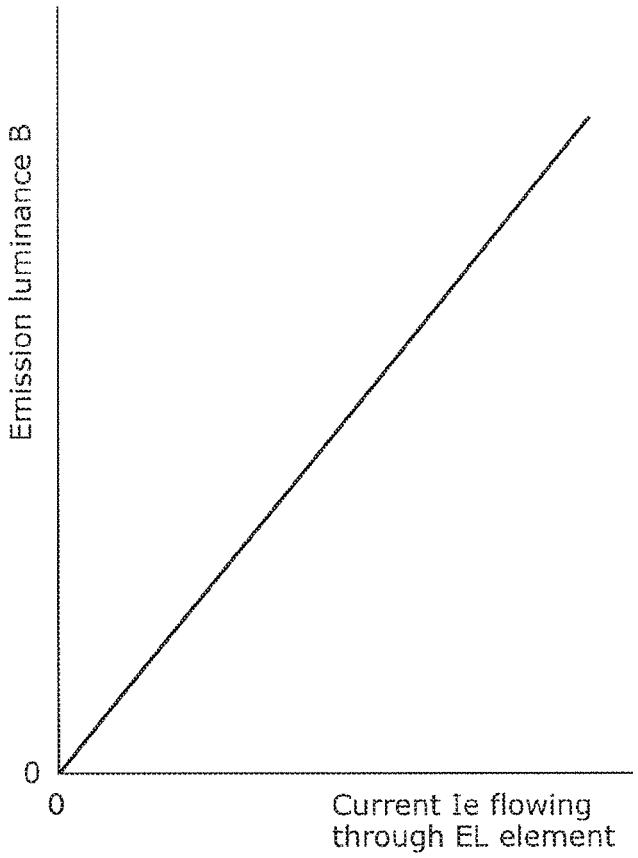
FIG. 25B is a graph showing the light emission characteristics of an EL element.

FIG. 25B shows a relationship between a current Ie that flows through the EL element and an emission luminance B of the EL element. The current Ie flowing through the EL element and the emission luminance B of the EL element have a proportional relationship.

The gate terminal-applied voltage V shown in FIG. 25A is the image signal voltage Vsig of the source driver IC, and the transistor current Id becomes the current Ie flowing through the EL element. Accordingly, in a voltage range greater than or equal to Vt, the image signal voltage Vsig and the emission luminance B of the EL element form a substantially squared curve, In order to facilitate the understanding, signals are expressed as luminance or voltage difference, but luminance or voltage difference corresponds to voltage or potential difference. Accordingly, luminance can be replaced by voltage. Also, luminance or voltage can be converted to electric power.

The signal output from the source driver is voltage, the voltage is written into the pixel and converted to a current by the driving transistor T5, and the current flows through the organic EL element OEL1 to cause the EL element to emit light to obtain a luminance. The voltage output from the source driver is converted to a luminance by a certain conversion coefficient or a means such as a conversion expression or a conversion table. Also, the potential difference (voltage difference) is converted to a voltage difference by a certain conversion coefficient or a means such as a conversion expression or a conversion table. For example, a voltage difference calculation unit 61 can be replaced by a voltage difference computation means.

Needless to say, the conversion coefficient and the like can be set by taking into consideration the efficiency of the EL element of each of the pixels of R, G and B. It will be appreciated that the foregoing description is applicable to other embodiments disclosed in the present specification. It will also be appreciated that it can be combined with other embodiments disclosed in the present specification.

The TCON 60 controls the operations of the above-described display pixel P1 and determines the order of writing in a single frame.

Figure 7:
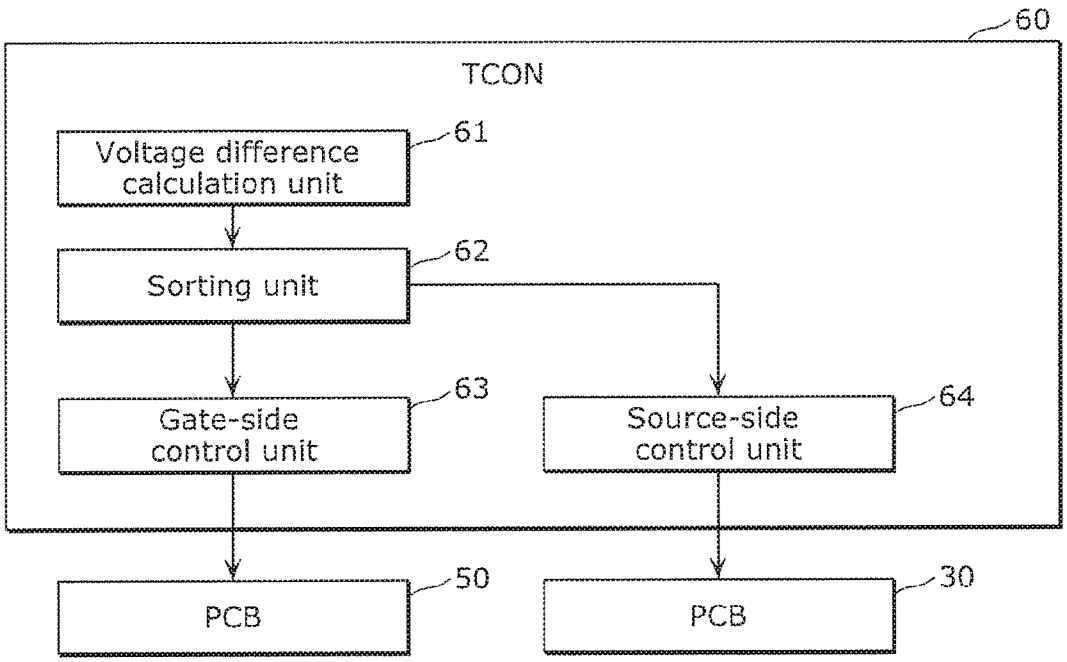
FIG. 7 is a block diagram showing an example of a functional configuration of a TCON according to the embodiment.

FIG. 7 is a block diagram showing an example of a functional configuration of the TCON 60. In FIG. 7, only constituent elements necessary to describe the present embodiment are shown, and thus other constituent elements are omitted. As shown in FIG. 7, the TCON 60 includes the voltage difference calculation unit 61, a sorting unit 62, a gate-side control unit 63, and a source-side control unit 64.

Detailed operations of these units will be described later.

The present embodiment will be described by taking an example in which the TCON 60 is composed of a dedicated LSI (Large Scale Integration), but the present embodiment is not limited thereto. The TCON 60 may be composed of a computer system including, for example, a microprocessor (MPU), a ROM, a RAM and the like. In this case, the above-described operations can be implemented by the microprocessor performing operations according to a computer program for executing the above-described operations.

[1-2. Operations of Organic EL Display]

Operations of the organic EL display 100 will be described with reference to FIGS. 8 to 15B.

As described above, in the organic EL display 100, determination of the order of writing in a single frame and control of the operations of the display pixels P1 are performed by the TCON 60.

[1-2-1. Determination of Order of Writing]

Determination of the order of writing performed by the TCON 60 will be described with reference to FIGS. 8 to 11.

Figure 8:
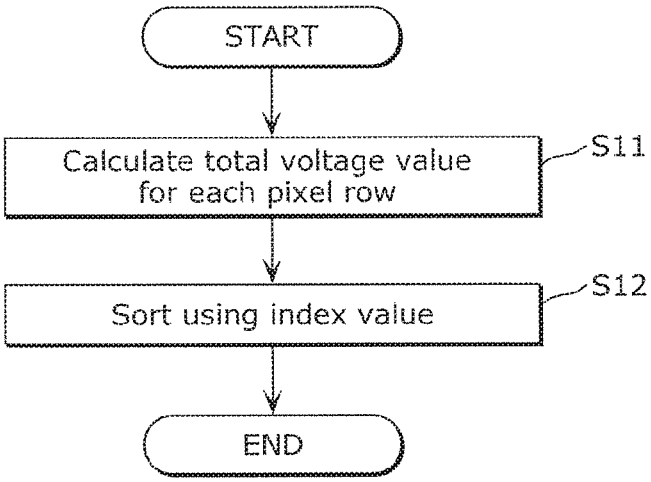
FIG. 8 is a flowchart illustrating operations of the TCON according to the embodiment.

FIG. 8 is a flowchart illustrating operations of the TCON 60. FIG. 9 is a diagram showing an example of a frame.

In order to reduce the output power of the source driver IC, the TCON 60 sorts the order of writing so as to reduce the difference in voltage signal (hereinafter, also referred to as "voltage difference", where appropriate) between two successive rows in the order of writing. As described above, the output power P of the source driver IC 20 is defined by $CV^2F$. That is, the output power P of the source driver IC 20 is determined according to the squared difference in voltage signal which corresponds to V. By sorting the order of writing so as to reduce the difference in voltage signal, the output power P of the source driver IC 20 can be reduced.

To be specific, first, in the present embodiment, the voltage difference calculation unit 61 (FIG. 7) calculates, for each row, an index value for setting the order of writing (S11). The index value indicates the voltage of each row. Here, as the index value, a total value of squared voltage signals ($=\Sigma_{k=1\ to\ m}(\mathrm{Luma}(k))^2$, where k represents an integer, m represents the number of pixels included in one row, and Luma(k) represents a voltage value indicated by the voltage signal of the corresponding display pixel P1 in k row) is calculated. This calculation is performed on all of the pixel rows.

For illustrative purpose, FIG. 9 shows the index values of 11 rows. Here, an example will be described in which the 11 rows are sorted. In FIG. 9, index values of 23, 17, 1, 5, 19, 2, 15, 29, 7, 18 and 2 are shown. Order of writing 1 indicates the order of writing before sorting, and an order is assigned sequentially from the first row.

In the present embodiment, the sorting unit 62 sorts the index values in ascending order and sets the order of writing based on the order in which the index values were sorted (S12). Order of writing 2 shown in FIG. 9 indicates the order of writing after sorting. In order of writing 2, the order is given as follows: the third row, the sixth row, the eleventh row, the fourth row, the ninth row, the seventh row, the second row, the tenth row, the fifth row, the first row and the eighth row.

Figure 10A:
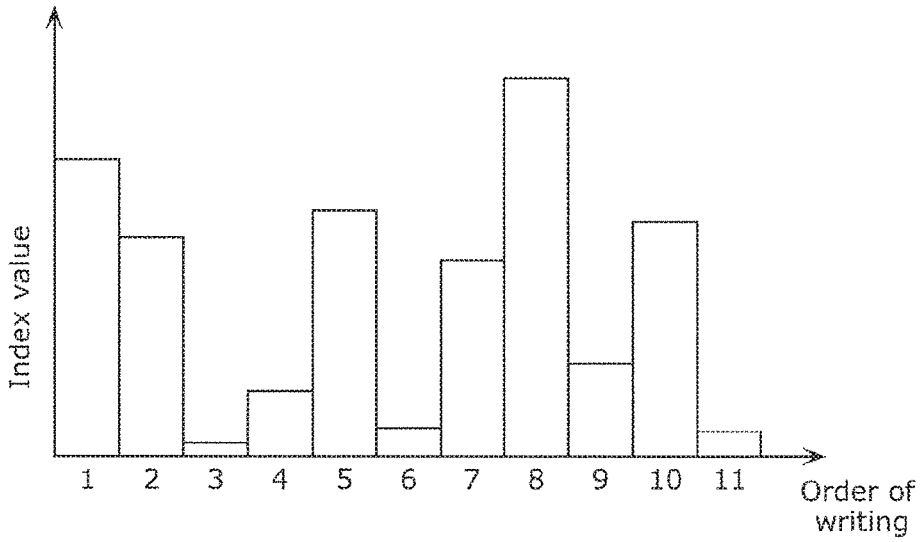
FIG. 10A is a graph showing the index values of pixel rows before the order of writing is sorted.

FIG. 10A is a graph showing the index values of the pixel rows before the order of writing is sorted.

However, in order to facilitate the understanding, in FIG. 10A, the index value (the value corresponding to the difference in voltage amplitude) of each pixel row is expressed as one index value, and the index values are plotted along the vertical axis.

The horizontal axis indicates the order of writing. In the case where a single screen includes 2160 pixel rows, the horizontal axis ranges from 1 to 2160. In order to simplify the drawings, and also, in order to facilitate the understanding, in FIG. 10A, the number of pixel rows is set to 11, showing the first to the eleventh pixel row.

Figure 10B:
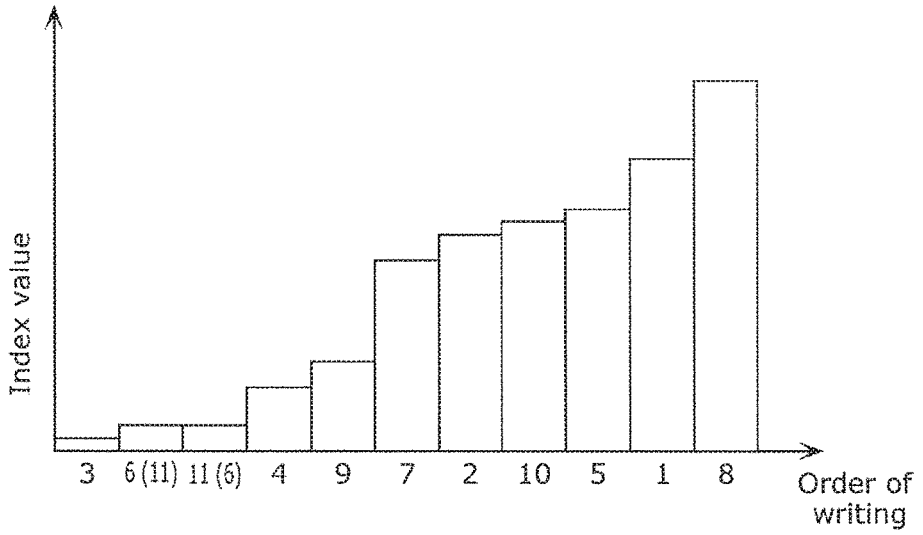
FIG. 10B is a graph showing the index values of pixel rows after the order of writing is sorted.

FIG. 10B is a graph showing the index values of the pixel rows after the order of writing is sorted. In FIGS. 10A and 10B, the vertical axis indicates index value, and the horizontal axis indicates the order of writing. Note that, however, each numerical value on the horizontal axis indicates the position of pixel row, indicated by the corresponding bar in the bar graph, in the order of writing.

In the graph shown in FIG. 10B, the difference in index value between two successive pixel rows in the order of writing is smaller than that in the graph shown in FIG. 10A. A smaller difference in index value means that the output power of the source driver IC 20 is smaller. As described above, the output power of the source driver IC 20 is defined by $CV^2F$, and is proportional to the squared output voltage difference V. By sorting the order of writing, the output voltage difference V can be reduced as shown in FIG. 10B, and thus the output voltage of the source driver IC 20 can be reduced.

Figure 11:
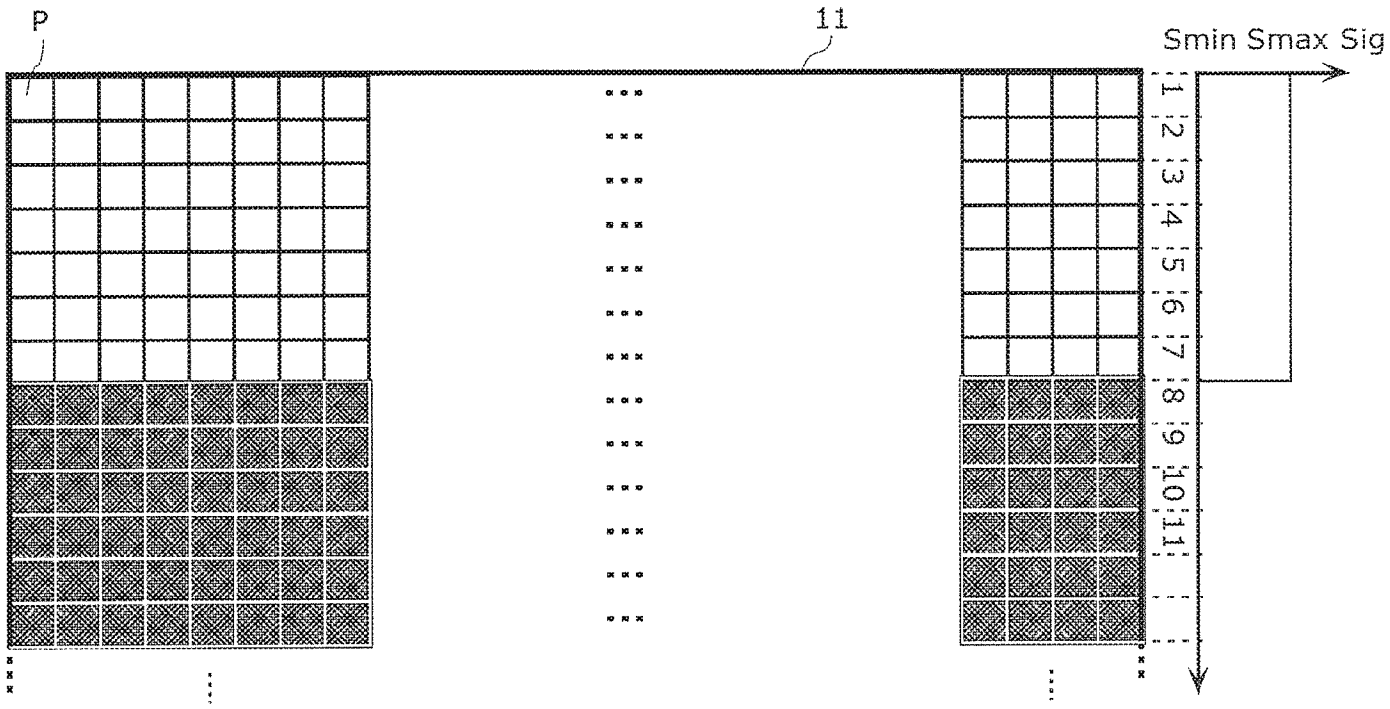
FIG. 11 is a diagram showing the output power of the source driver IC when the order of writing in the frame shown in FIG. 4 is sorted by a method according to the embodiment.

FIG. 11 is a diagram showing the output voltage of the source driver IC 20 when the order of writing in the frame shown in FIG. 4 is sorted by the method according to the present embodiment. In the example of the present disclosure shown in FIG. 11, first, the pixel rows having the maximum voltage Smax are sequentially selected to apply voltage to each pixel row, and next, the pixel rows having the minimum voltage Smin are sequentially selected to apply voltage to each pixel row. As a result, the order assigned to each pixel row is as shown in FIG. 11. The display of the display screen of the display panel is as shown in FIG. 4.

In FIG. 11, a voltage difference in output voltage occurs only between the seventh pixel row and the eighth pixel row, from which it can be seen that the driving capability required for the source driver IC 20 can be dramatically reduced, and the amount of heat generation can also be reduced as compared with FIG. 4.

FIG. 10B shows an example in which the order of writing is sorted by sorting the index values in ascending order (in order from the smallest), but it is also possible to sort the index values in descending order (in order from the largest).

Figure 10C:
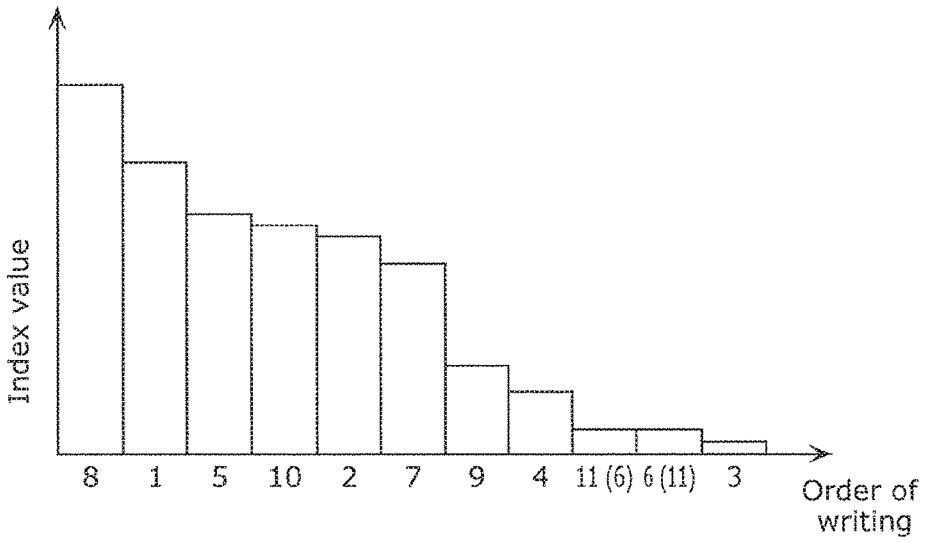
FIG. 10C is a graph showing the index values of pixel rows after the order of writing is sorted.

FIG. 10C is a graph showing the index values of the pixel rows after the order of writing is sorted. In FIG. 10C, the vertical axis indicates index value, and the horizontal axis indicates the order of writing. Note that, however, each numerical value on the horizontal axis indicates the position of pixel row, indicated by the corresponding bar in the bar graph, in the order of writing. In the case of FIG. 10C as well, as in FIG. 10B, the output voltage difference V can be reduced, and thus the output voltage of the source driver IC 20 can be reduced.

The image signal voltage is stored in a built-in frame memory included in the TCON or the like. The voltage value of each pixel row is determined by using the data stored in the frame memory.

To describe it simply, the voltage value of the image signal applied to each pixel is summed for each pixel row, and the order in which the pixel rows are selected is determined by using the sum. The pixel rows are selected by the gate driver IC. For example, as shown in the table on the right side of FIG. 9, in the case where the sum of the voltage of each pixel row is 23, 17, 1, 5, 19, . . . , 18 and 2, the third, sixth, eleventh, fourth, seventh, . . . , first, and eighth rows are sequentially selected, and the image signal voltage is applied to the pixels of each pixel row from the source driver.

Figure 23:
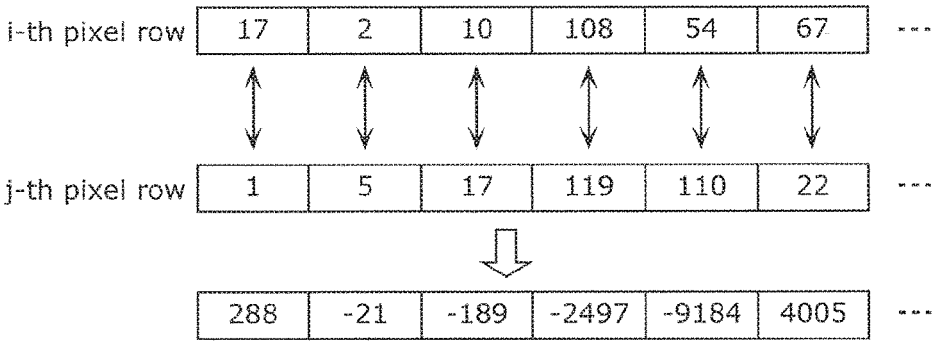
FIG. 23 is a diagram showing an example of a method of sorting the order of writing according to Variation 5.

As illustrated in FIG. 23, it necessary to obtain a voltage difference (image signal voltage difference) between each pair of pixels connected to different source signal lines. The voltage difference between each pair of pixels is summed for each pixel row, and the resulting sums are compared in terms of magnitude so as to obtain the order in which the pixel rows are selected. If it is assumed that there are n pixel rows, n−1 sets can be conceived for the voltage difference between each pair of pixels in the first pixel row and the second pixel row. Combinatorial computation can be obtained by performing computation processing using the data stored in the memory.

The power of the source driver can be reduced by sorting the order of pixel rows in which writing is performed.

Obtaining a voltage difference (image signal voltage difference) between each pair of pixels connected to different source signal lines is the most accurate implementation means. However, the amount of computation is large. In order to select the pixel rows in which writing is performed, comparison is performed between representative values of pixel rows (for example, odd-numbered pixel rows, even-numbered pixel rows, pixel rows corresponding to multiples of 16, etc.), and the order of pixel rows in which the difference in index value (computation value) between the pixel rows is minimized is obtained, and it is thereby possible to reduce the amount of computation.

It will be appreciated that the foregoing description is applicable to other embodiments disclosed in the present specification. It will also be appreciated that it can be combined with other embodiments disclosed in the present specification.

[1-2-2. Operations of Display Pixel]

Operations of a display pixel P1 will be described with reference to FIGS. 12A to 15B.

As a result of having the above-described configuration, the display pixel P1 can perform writing processing of writing the image signal voltage Vsig (voltage signal) and light emission processing of causing the organic EL element to emit light independently of each other. To be specific, in the display pixel P1 according to the present embodiment, writing processing, reset processing, copy processing (duplication processing) and light emission processing are executed.

FIGS. 12A to 12D are diagrams illustrating four processing operations of the display pixel P1. Each processing is executed by the TCON 60 controlling the circuits constituting the organic EL display 100.

Figure 12A:
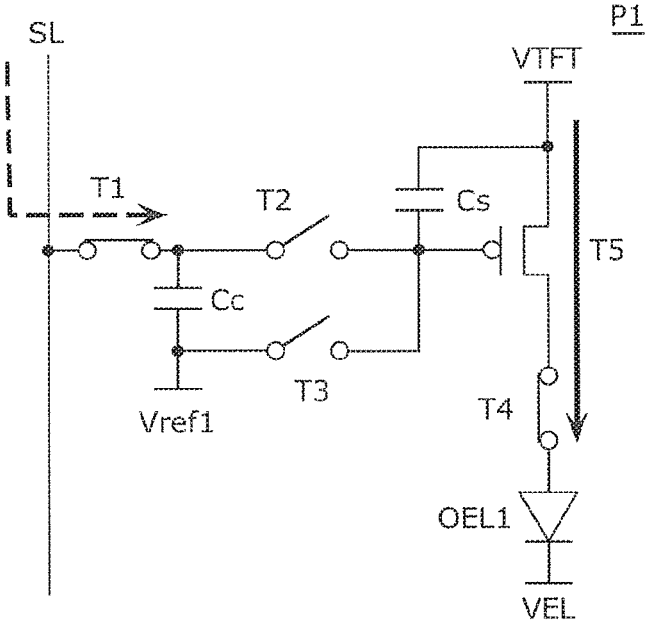
FIG. 12A is a diagram showing the state of switching elements during writing processing.
Figure 12B:
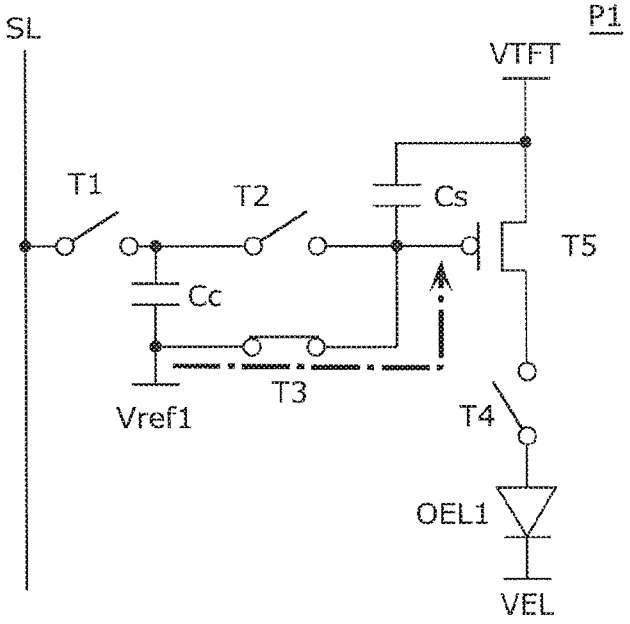
FIG. 12B is a diagram showing the state of switching elements during reset processing.
Figure 12C:
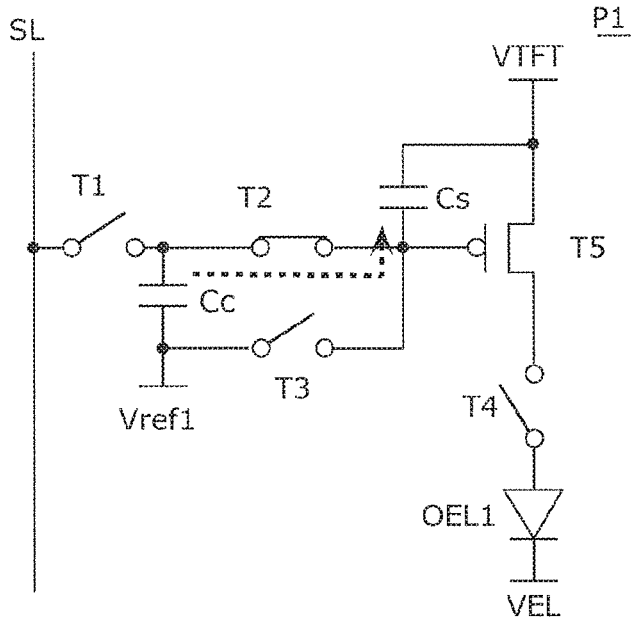
FIG. 12C is a diagram showing the state of switching elements during copy processing.
Figure 12D:
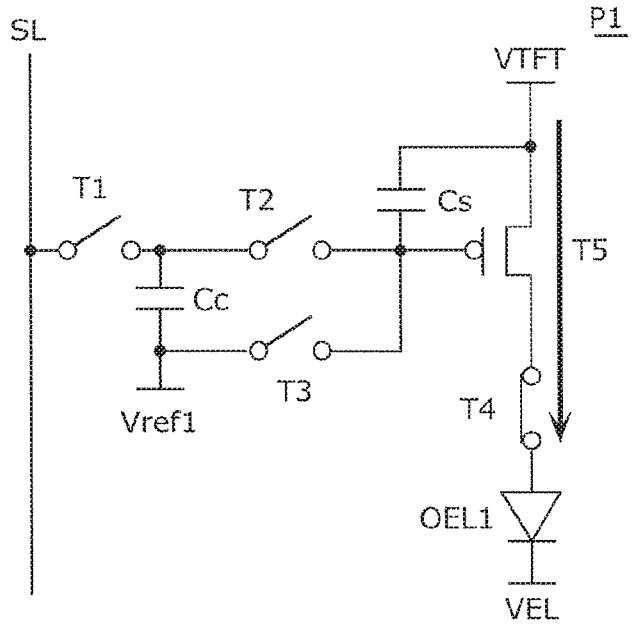
FIG. 12D is a diagram showing the state of switching elements during light emission processing.

FIGS. 12B and 12C are simultaneously carried out on all pixels of the display screen during a blanking interval of a frame. FIG. 12A is carried out during the time other than the blanking interval of a frame, and an image signal voltage is applied to the capacitors Cc for each pixel row sequentially from the top to bottom of the screen. FIG. 12D is carried out during the time other than the blanking interval of a frame.

In the writing processing, a voltage signal is written into the capacitor Cc according to the current voltage signal of the capacitor Cs while the organic EL element OEL1 is caused to emit light.

FIG. 12A is a diagram showing the state of the switching elements T1 to T4 during the writing processing. As shown in FIG. 12A, in the writing processing, the switching elements T1 and T4 are turned on, and the switching elements T2 and T3 are turned off. By setting the state of the transistors in this manner, the next voltage signal can be written into the capacitor Cc while the organic EL element OEL1 is caused to emit light according to the current voltage signal.

In the reset processing, the capacitor Cs is reset while the light emission of the organic EL element OEL1 is stopped.

FIG. 12B is a diagram showing the state of the switching elements T1 to T4 during the reset processing. As shown in FIG. 12B, in the reset processing, the switching element T3 is turned on, and the switching elements T1, T2 and T4 are turned off. As a result of the switching elements T1 and T2 being turned off, an electric charge corresponding to the next voltage signal is stored in the capacitor Cc. Also, because the switching element T3 is turned on, a voltage Vref1 is input to the gate terminal of the driving transistor T5 and one end of the capacitor Cs. The driving transistor T5 is thereby initialized. During the period in which the reset processing is executed, the switching element T4 is off, and thus the organic EL element OEL1 does not emit light.

By setting the voltage Vref1 to a voltage that turns off the driving transistor T5 (a voltage less than or equal to Vt), even when the voltage Vref1 is applied to the gate terminal of the driving transistor T5, the driving transistor T5 can be kept cut off. Accordingly, even when the switching element T4 is on, current is not supplied from the driving transistor T5 to the organic EL element OEL1. In this case, it is unnecessary to turn off the switching element T4.

In the copy processing, the next voltage signal written into the capacitor Cc is copied to the capacitor Cs while the light emission of the organic EL element OEL1 is stopped.

FIG. 12C is a diagram showing the state of the switching elements T1 to T4 during the copy processing. As shown in FIG. 12C, in the copy processing, the switching element T2 is turned on, and the switching elements T1, T3 and T4 are turned off. As a result of the switching element T3 being turned off and the switching element T2 being turned on, one end of the capacitor Cc and one end of the capacitor Cs are connected, and thus the next voltage signal written into the capacitor Cc can be copied to (written into) the capacitor Cs. During the period in which the copy processing is executed, the switching element T4 is off, and thus the organic EL element OEL1 does not emit light.

In the light emission processing, light emission of the organic EL element OEL1 is performed. FIG. 12D is a diagram showing the state of the switching elements T1 to T4 during the light emission processing. As shown in FIG. 12D, in the light emission processing, the switching element T4 is turned on, and the switching elements T1 to T3 are turned off. By setting the state of the transistors in this manner, the organic EL element OEL1 can be caused to emit light according to the next voltage signal.

As illustrated in FIG. 12A, in the pixel configuration according to the present disclosure, an image signal voltage can be written into the pixel while current is supplied to the organic EL element OEL1. The voltage corresponding to the image signal written into the pixel during the previous frame period is stored in the capacitor Cs, and the driving transistor T5 supplies current to the organic EL element OEL1 based on the voltage stored in the capacitor Cs.

In the current frame period, the pixel rows are sequentially selected by the gate driver IC (circuit), and the source driver IC applies an image signal to the selected pixels. The voltage corresponding to the image signal is stored in the capacitor Cc of each pixel. During each blanking interval of a frame, the voltage stored in the capacitor Cc is copied to the capacitor Cs. During this period, the display screen is maintained in a non-display state.

In the next frame period, the driving transistor T5 supplies current to the organic EL element OEL1 based on the voltage stored in the capacitor Cs.

As described above, a feature of the present disclosure is that the pixel according to the embodiment of the present disclosure includes capacitors Cs and Cc that store a voltage based on the image signal.

In the example described above, the pixel is configured to include capacitors Cs and Cc that store a voltage based on the image signal, but the configuration is not limited thereto. It is possible to for example, construct two memory circuits by using transistors or the like, and store the voltage based on the image signal in the memory circuits. It is also possible to store the voltage based on the image signal in the gate capacitance of MOS transistors.

It will be appreciated that the foregoing description is applicable to other embodiments disclosed in the present specification. It will also be appreciated that it can be combined with other embodiments disclosed in the present specification.

By repeatedly executing the writing processing, the reset processing, the copy processing and the light emission processing, an image (for example, a moving image) can be displayed. Note that in the light emission processing, by simultaneously switching the switching elements T4 of all display pixels P1 from off to on, the display of the frame can be switched simultaneously by all of the pixels. That is, it is possible to prevent a situation in which two frames are displayed in a mixed-up manner.

[1-3. Advantageous Effects]

Figure 13:
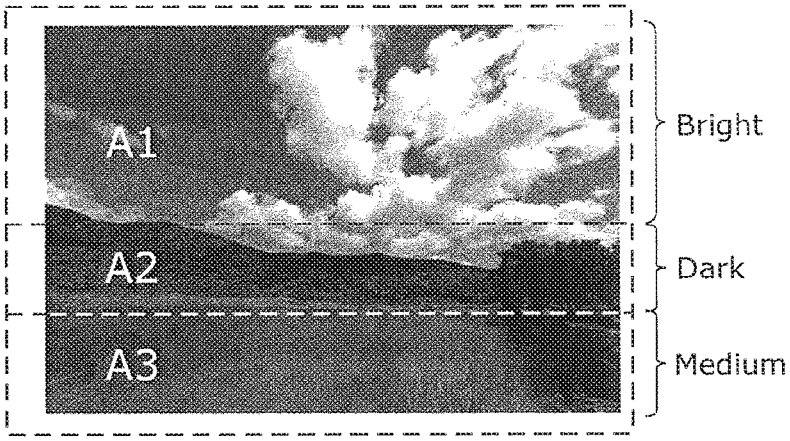
FIG. 13 is a diagram showing an example of a frame.

FIG. 13 is a diagram showing an example of a frame.

In the present embodiment, the order of writing is sorted by, for example, sorting the total luminance value in order from the smallest, and thus in the frame shown in FIG. 13, a relatively dark region A2 is written first, an intermediate brightness region A3 is written next, and a relatively bright region A1 is written in the last. In the present embodiment, the order of writing is sorted, and thus the image is replaced in the order of the region A2, the region A3 and the region A1.

As used herein, the expression "replaced in the order of the region A2, the region A3 and the region A1" is a conceptual expression used to facilitate the understanding. According to the driving method of the embodiment of the present disclosure, the pixel rows are selected so as to reduce the voltage difference between pixel rows or between pixels of the pixels. Accordingly, in each of the regions A1, A2 and A3, the pixel rows are not selected sequentially from the top to bottom or from the bottom to top of the screen (however, from the ease of implementation, the case where in each of the regions A1, A2 and A3, the pixel rows are selected sequentially from the top to bottom or from the bottom to top of the screen is also encompassed by the present disclosure). For example, it will be appreciated that it is also possible to, for example, perform writing to some of the pixel rows of the region A1, next perform writing to some of the pixel rows of the region A3, and then perform writing to some of the remaining pixel rows of the region A1.

Here, if, instead of the display pixel P1 of the present embodiment that can perform writing of voltage signal and display of image in an independent manner, a display pixel that cannot perform these operations in an independent manner is used, a period occurs in which two frames are displayed in a mixed-up manner on a single screen.

Figure 14A:
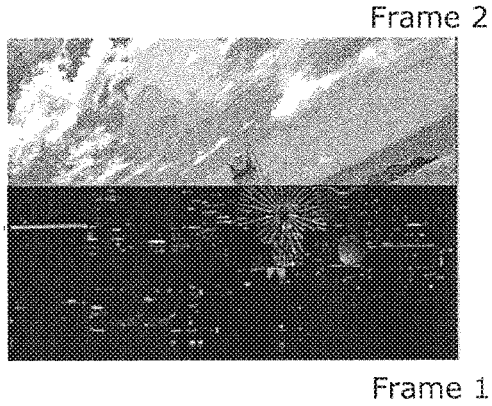
FIG. 14A is a diagram showing an example of a display screen according to a comparative example at the time of switching of the frame.
Figure 14B:
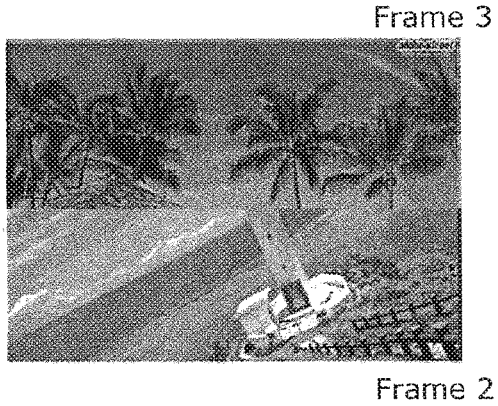
FIG. 14B is a diagram showing an example of a display screen according to the comparative example at the time of switching of the frame.

FIGS. 14A and 14B are diagrams showing an example of a display screen according to a comparative example at the time of switching of the frame. FIGS. 14A and 14B show a state of image that is actually displayed on the screen. This comparative example is an example in which writing of voltage signal and display of image cannot he performed in an independent manner, and the pixel rows are selected sequentially from the top to bottom (in order from the first pixel row).

As shown in FIGS. 14A and 14B, in the comparative example, two frames are displayed in a mixed-up manner on a single screen. As shown in FIG. 14A, when the frame is switched from frame 1 to frame 2, frames 1 and 2 are displayed in a mixed-up manner, with the image of frame 2, which is the next frame, being displayed in the upper portion of the screen, and the image of frame 1, which is the current frame, being displayed in the lower portion of the screen. As shown in FIG. 14B, when the frame is switched from frame 2 to frame 3, frames 2 and 3 are displayed in a mixed-up manner, for example, with the image of frame 3, which is the next frame, being displayed in the upper portion of the screen, and the image of frame 2, which is the current frame, being displayed in the lower portion of the screen.

Here, in the present embodiment, as described above, in FIG. 13, the voltage signal is written in the order of the region A2, the region A3 and the region A1. When writing of voltage signal and display of image cannot be performed in an independent manner, two frames are displayed in a more randomly mixed-up manner than the images shown in FIGS. 14A and 14B, which may lower the image quality.

Also, even in a single frame, discomfort occurs in the displayed image in the following case, for example, where the image of the region A1 is replaced, the image of the region A3 is replaced next, and the image of the region A2 is then replaced. Unlike the case where the image is replaced sequentially in the vertical direction on the screen, the image displayed in a specific region of the display screen is replaced, and thus the region where the displayed image is replaced appears as noise. This is noticeable particularly when the displayed image is a moving image.

In contrast, according to the present embodiment, as described above, the display pixel P1 that can perform writing of voltage signal and display of image in an independent manner is used. For this reason, switching of image is performed simultaneously on all pixel rows in the light emission processing.

The image for which writing of voltage signal is performed is not displayed as the display image, and is displayed on the display screen based on the voltage of the capacitor Cs after the writing of the voltage has finished. Accordingly, as in FIG. 13, even when writing of voltage signal is performed in the order of the region A2, the region A3 and the region A1, the image for which writing of the voltage is performed is not displayed, and thus the discomfort that occurs in the displayed image according to the conventional technique does not occur.

Figure 15A:
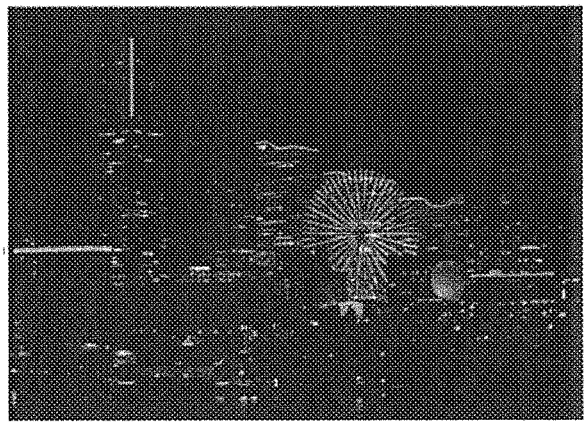
FIG. 15A is a diagram showing an example of a display screen according to the embodiment at the time of switching of the frame.
Figure 15B:
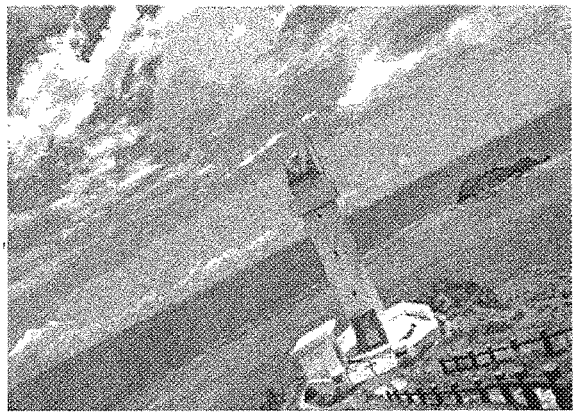
FIG. 15B is a diagram showing an example of a display screen according to the embodiment at the time of switching of the frame.

FIGS. 15A and 15B are diagrams showing an example of a display screen at the time of switching of the frame when the display pixel P1 according to the present embodiment is used. FIGS. 15A and 15B show a state of image that is actually displayed on the screen.

In the present embodiment, as shown in FIGS. 15A and 15B, switching of image is performed on all pixel rows at the same timing. It is preferable that switching of image is carried out during a blanking interval of one frame period. In the case where one frame is composed of a plurality of sub-fields, it is preferable to perform switching of image signal during blanking intervals of all sub-fields or an arbitrary sub-field period. In the present embodiment, a situation in which two frames are displayed in a mixed-up manner on a single screen does not occur. As described above, in the present embodiment, because the order of writing is sorted, when writing of voltage signal and display of image cannot be performed in an independent manner, two frames may be displayed in a fragmentary and mixed-up manner on a single screen. However, by using the display pixel P1 of the present embodiment, writing of voltage signal and display of image can be performed in an independent manner, a situation in which two frames are displayed in a mixed-up manner on a single screen does not occur, and thus the lowering of image quality caused by sorting of the order of writing can be prevented.

From the above, with the organic EL display 100 of the present embodiment, the order of writing can be sorted, and writing of voltage signal and display of image can be performed in an independent manner. Accordingly, with the organic EL display 100, the driving capability required for the source driver IC can be reduced without lowering the image quality, and the amount of heat generation from the source driver IC can be suppressed, and it is therefore possible to eliminate the need to provide a special heat dissipation mechanism.

[1-4. Variation 1: Case 1 Where Frame is Composed of Plurality of Sub-Fields]

Variation 1 will be described with reference to FIGS. 16 to 18.

In the present variation, a case will be described where a frame is formed by superimposing a plurality of sub-fields.

Figure 16:
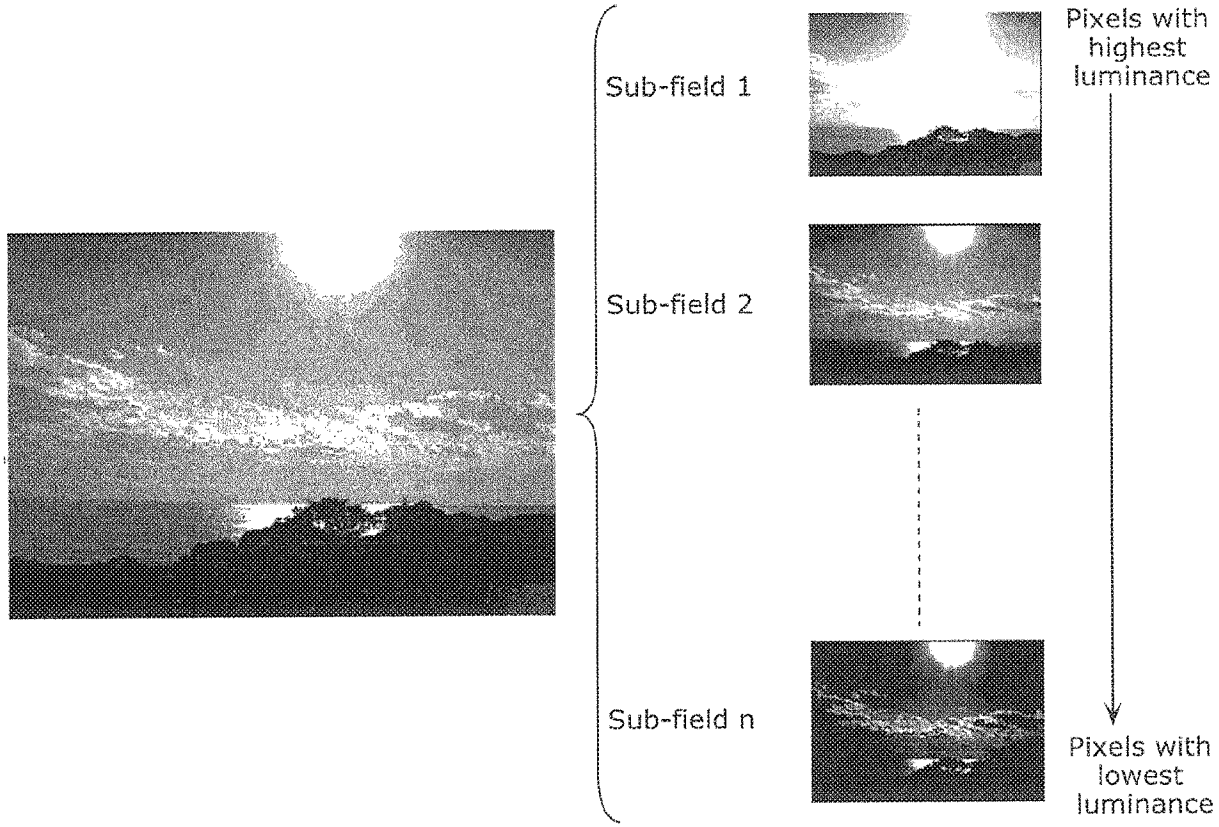
FIG. 16 is a diagram showing an example of a frame composed of a plurality of sub-fields.

FIG. 16 is a diagram showing an example of a frame composed of a plurality of sub-fields. The sub-fields having a smaller value of suffix (numeral) have a higher luminance value and the sub-fields having a greater value of suffix have a lower luminance value. For each display pixel P1, by selecting a sub-field to be illuminated according to the luminance value, a desired luminance can be obtained.

The image signal of one frame is decomposed into a plurality of sub-fields. In the example shown in FIG. 16, the image signal is divided into sub-fields according to the luminance (brightness). Needless to say, the image signal may be divided into sub-fields in order from the most-significant bit to the least-significant bit of image data. For example, in the case where the image signal includes 8 bits, one frame is composed of eight sub-fields. The source driver IC outputs, for each sub-field, a voltage value obtained by weighting the bit to the source signal lines. In this case, the index value of each pixel row can be acquired by obtaining the number of bits indicating "1". Also, the index value of each pixel row can be acquired by comparing the positions of bits indicating "1" with another pixel row. It will be appreciated that the foregoing description is applicable to other embodiments disclosed in the present specification. It will also be appreciated that it can be combined with other embodiments disclosed in the present specification.

Figure 17:
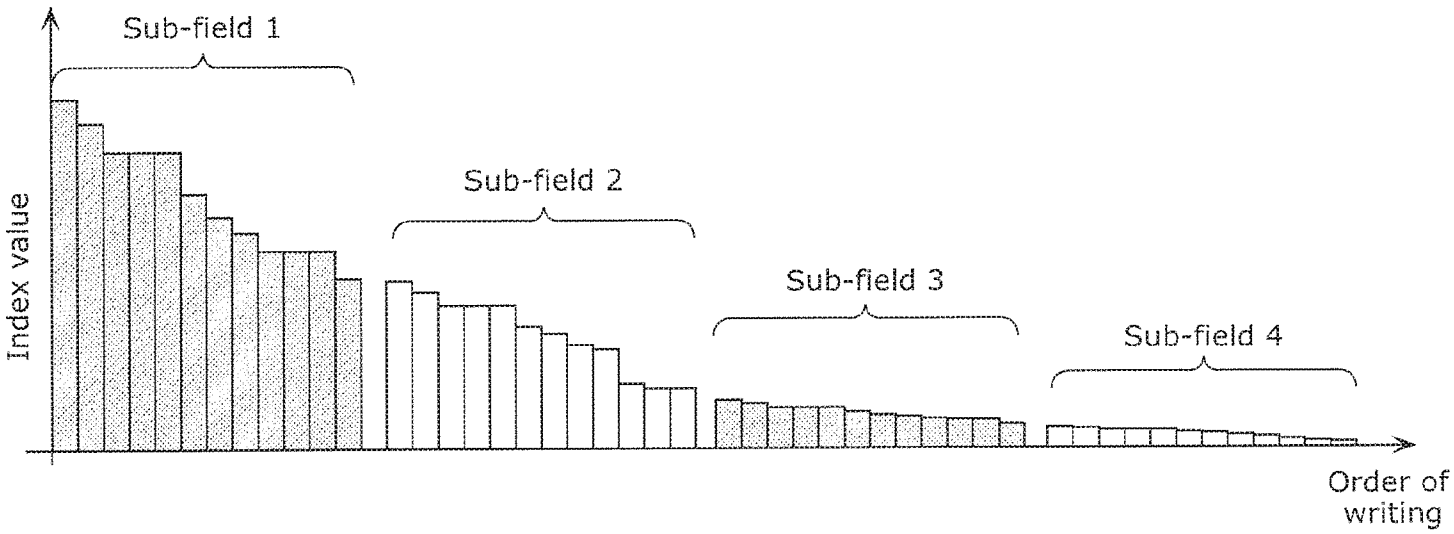
FIG. 17 is a diagram showing an example of output power of a source driver IC according to Variation 1.
Figure 18:
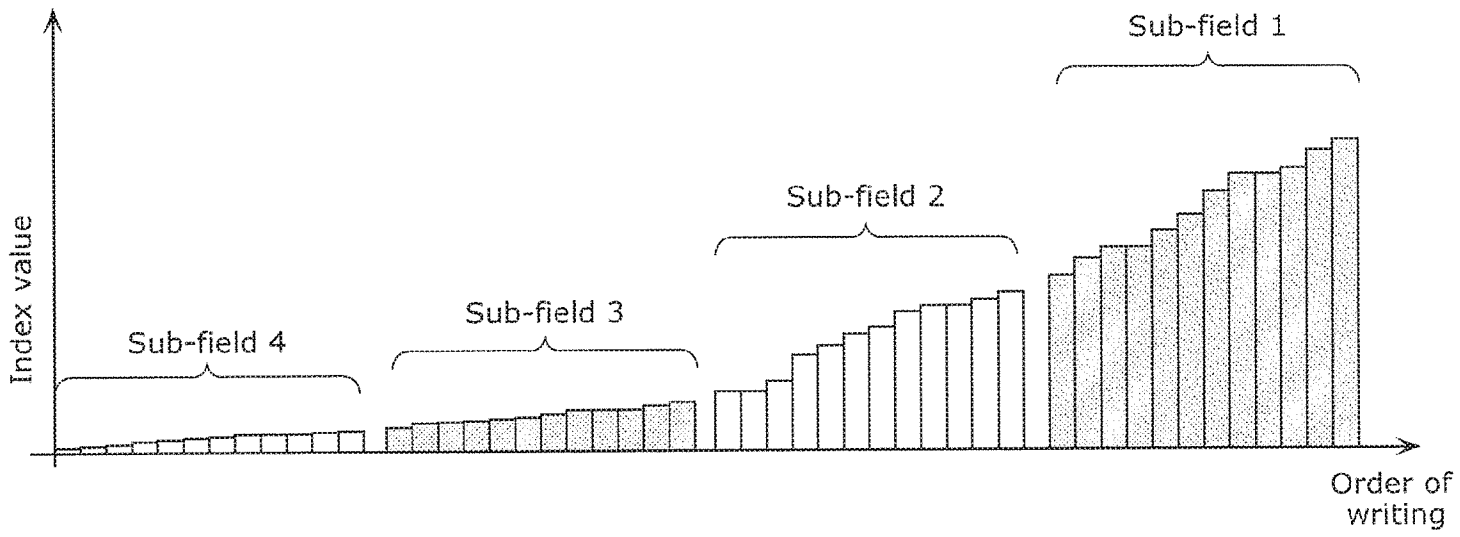
FIG. 18 is a diagram showing an example of output power of the source driver IC according to Variation 1.

FIGS. 17 and 18 are diagrams showing an example of output power of a source driver IC 20 according to the present variation.

In FIGS. 17 and 18, first, the order of writing is sorted in each sub-field. For the sake of description, FIGS. 17 and 18 show an example in which one frame is composed of four sub-fields.

In FIG. 17, the order of writing is sorted in each sub-field without sorting the order of display of the fields. In FIG. 17, in each of sub-fields 1 to 4, the index value (=a total value of squared voltage signals) is sorted in descending order, and the order of writing is set according to the order in which the index values were sorted. As described above, the index value decreases in the order of sub-fields 1 to 4 (the index values of sub-field 1>the index values of sub-field 2>the index values of sub-field 3>the index values of sub-field 4). Accordingly, when the index values are sorted in descending order in each field, in the entire frame, the index value is sorted in descending order. By doing so, the difference in output voltage of the source driver IC 20 can be reduced in the entire frame.

In FIG. 18, the order of display of sub-fields is set as follows: sub-field 4, sub-field 3, sub-field 2 and sub-field 1. Furthermore, in FIG. 18, the index value is sorted in ascending order in each sub-field. That is, in FIG. 18, in the entire frame, the index value is sorted in ascending order. By doing so, the difference in output voltage of the source driver IC 20 can be reduced.

The image signal voltage is stored in a built-in frame memory included in the TCON 60 or the like. The frame memory is further divided into a plurality of sub-fields. First, frame memory data is computed, and the image data is divided into a plurality of sub-fields. By using the data stored in the memory, the voltage values of the pixel rows of each sub-field are obtained.

To describe it simply, the voltage value of the image signal applied to each pixel is summed for each pixel row of each sub-field, and the order in which the gate signal lines are selected is determined by using the sum.

It is necessary to obtain a voltage difference (image signal voltage difference) between each pair of pixels connected to different source signal lines. The voltage difference between each pair of pixels is summed for each pixel row, and the resulting sums are compared in terms of magnitude so as to obtain the order in which the pixel rows are selected. If it is assumed that there are n pixel rows, n−1 sets can be conceived for the voltage difference between each pair of pixels in the first pixel row and the second pixel row. Combinatorial computation can be obtained by performing computation processing using the data stored in the memory.

The power of the source driver IC 20 can he reduced by sorting the order of pixel rows in which writing is performed. Obtaining a voltage difference (image signal voltage difference) between each pair of pixels connected to different source signal lines is the most accurate implementation means. However, the amount of computation is large. In order to select the pixel rows in which writing is performed, comparison is performed between representative values of pixel rows (for example, odd-numbered pixel rows, prime-numbered pixel rows, pixel rows corresponding to multiples of 64, etc.), and the order of pixel rows in which the difference in index value (computation value) between pixel rows is minimized is obtained, and it is thereby possible to reduce the amount of computation. Also, it is preferable to change the representative values of the pixel rows (for example, odd-numbered pixel rows, prime-numbered pixel rows, pixel rows corresponding to multiples of 64, etc.) for each sub-field. It will be appreciated that the foregoing description is applicable to other embodiments disclosed in the present specification. It will also be appreciated that it can be combined with other embodiments disclosed in the present specification.

[1-5. Variation 2: Case 2 Where Frame is Composed of Plurality of Sub-Fields]

Variation 2 will be described with reference to FIGS. 19 and 20.

In the present variation, as in Variation 1, a case will be described where a frame is formed by superimposing a plurality of sub-fields.

In Variation 1, the index value is sorted in ascending order or in descending order, but in the present variation, a selection is made as to whether the index value is sorted in ascending order or in descending order for each sub-field or frame (each image).

Also, in the present variation, the sub-fields are defined by a factor other than the magnitude of luminance value such as in order from the most-significant bit to the least-significant bit. Accordingly, if the index value is sorted in the same manner as in Variation 1, although the difference in index value can be reduced in each sub-field, it may not be possible to reduce the difference in index value between fields.

To be specific, in the present variation, the TCON 60 obtains minimum and maximum index values in the current sort processing. The TCON 60 compares a final index value, which is the index value of the last row in the order of writing in the previous sub-field (or frame), with the minimum arid maximum index values in the current sub-field (or frame). If the difference between the final index value and the minimum index value is smaller than the difference between the final index value and the maximum index value, the TCON 60 sorts the index value in ascending order. If the difference between the final index value and the maximum index values is smaller than the difference between the final index value and the minimum index value, the TCON 60 sorts the index value in descending order.

Figure 19:
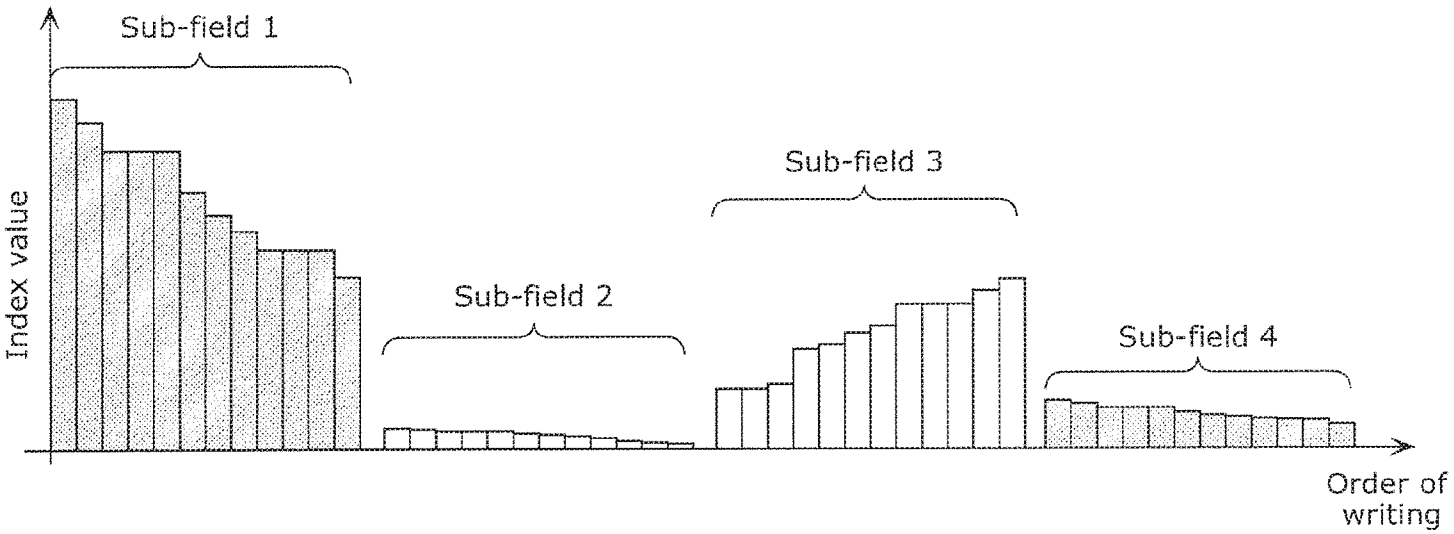
FIG. 19 is a diagram showing an example of output power of a source driver IC according to Variation 2.
Figure 20:
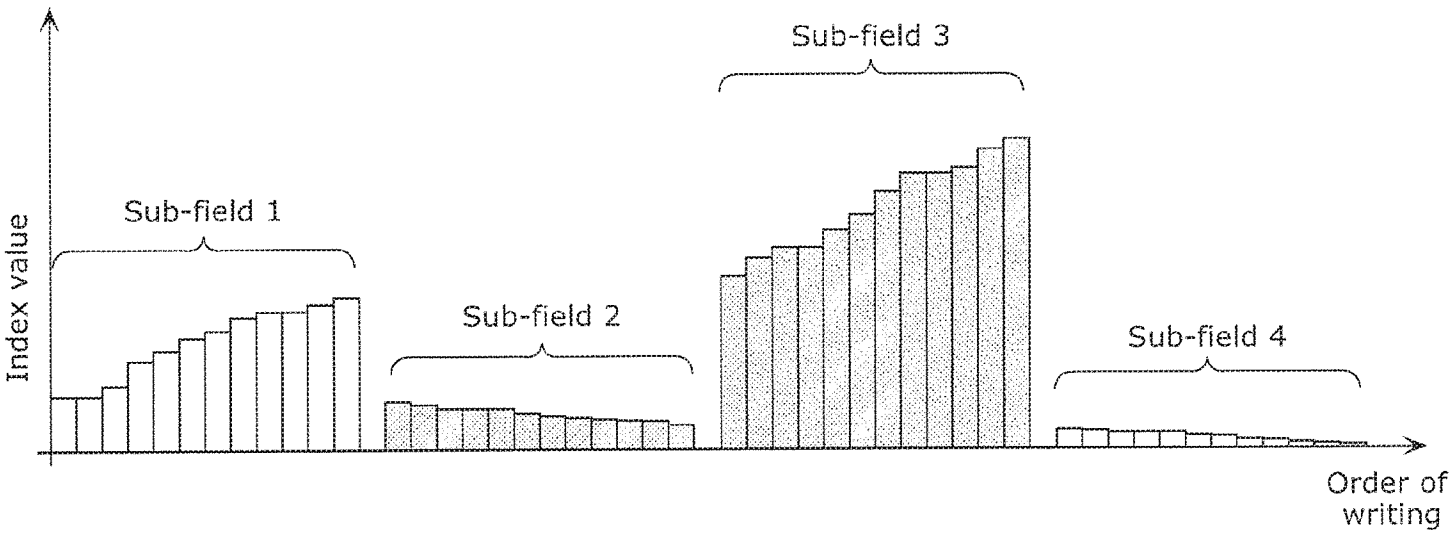
FIG. 20 is a diagram showing an example of output power of the source driver IC according to Variation 2.

FIGS. 19 and 20 are diagrams showing an example of output power of a source driver IC 20 according to the present variation.

In FIGS. 19 and 20, first, the order of writing is sorted in each sub-field. Also, FIGS. 19 and 20 show, for the sake of description, an example in which one frame is composed of four sub-fields.

As can be seen from FIG. 19, in sub-field 1 that is the first sub-field, the index value is sorted in descending order. The final index value of sub-field 1 is the minimum index value of sub-field 1. The difference between the final index value of sub-field 1 and the maximum index value of sub-field 2 is smaller than the difference between the final index value of sub-field 1 and the minimum index value of sub-field 2. Accordingly, in sub-field 2, the index value is sorted in descending order.

Likewise, the difference between the minimum index value of sub-field 2 and the minimum index value of sub-field 3 is smaller than the difference between the minimum index value of sub-field 2 and the maximum index value of sub-field 3. Accordingly, in sub-field 3, the index value is sorted in ascending order.

Likewise, the difference between the maximum index value of sub-field 3 and the maximum index value of sub-field 4 is smaller than the difference between the maximum index value of sub-field 3 and the minimum index value of sub-field 4. Accordingly, in sub-field 4, the index value is sorted in descending order.

By doing so, the difference in output voltage of the source driver IC 20 can be reduced not only in each field, but also between fields.

In FIG. 19, in sub-field 1 that is the first sub-field, the index value is sorted in descending order, but in FIG. 20, in sub-field 1 that is the first sub-field, the index value is sorted in ascending order.

In FIG. 20, in sub-fields 1 and 3 that are odd-numbered sub-fields in the order of display, the index value is sorted in ascending order, and in sub-fields 2 and 4 that are even-numbered sub-fields in the order of display, the index value is sorted in descending order.

As in the case of FIG. 19, even when the order of writing is set as shown in FIG. 20, the difference in output voltage of the source driver IC 20 can be reduced not only in each field, but also between fields.

In the present variation, a selection is made as to whether the index value is sorted in descending order or in ascending order for each sub-field, but the selection may be made for each frame.

According to the present variation, a selection is made as to whether the index value is sorted in descending order or in ascending order for each sub-field or frame, and thus the present variation is useful particularly when the sub-fields are not ordered according to the luminance value.

[1-6. Variation 3: Another Example 1 of Method of Sorting Order of Writing]

Variation 3 will be described with reference to FIG. 21.

Figure 21:
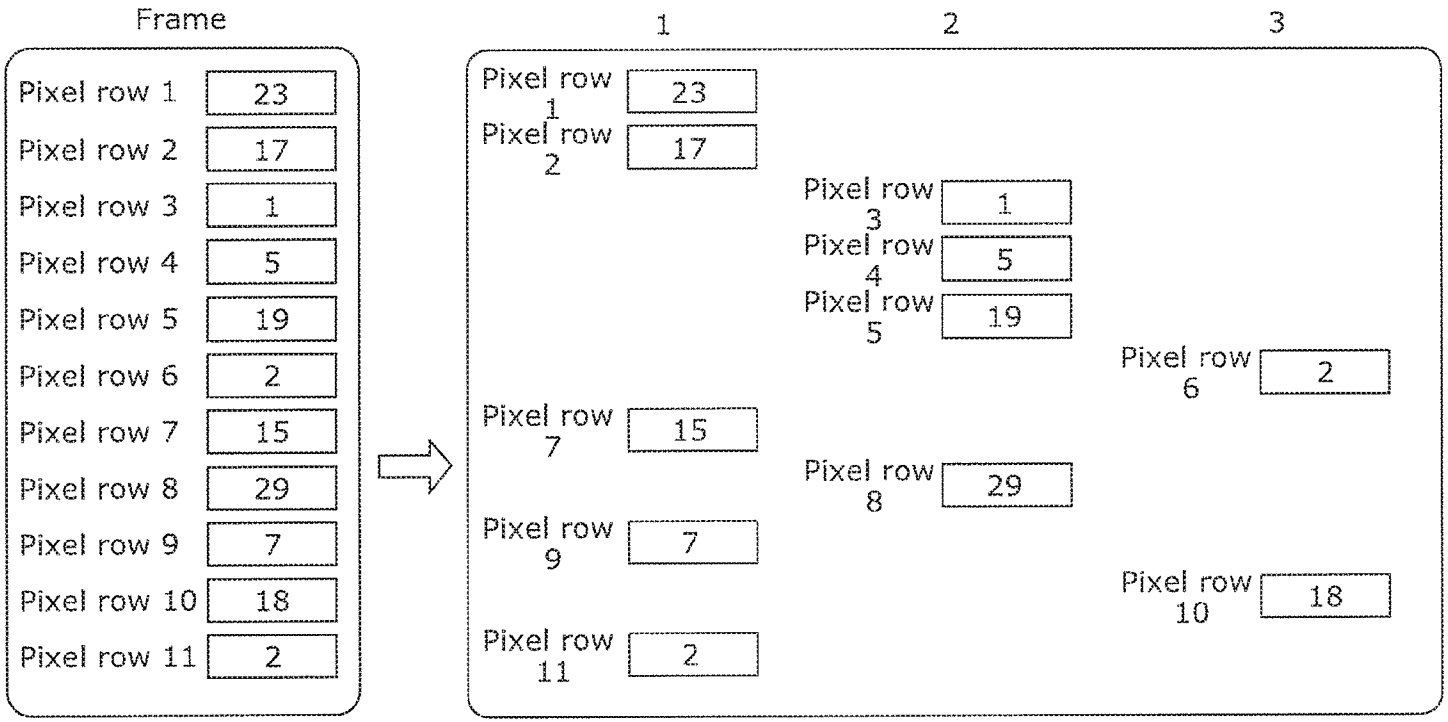
FIG. 21 is a diagram showing an example of a method of sorting the order of writing according to Variation 3.

FIG. 21 is a diagram showing an example of a method of sorting the order of writing according to the present variation.

In the present variation, the TCON 60 executes first search processing and second search processing, which will be described below.

In the first search processing, the TCON 60 sets rows for which the order of writing has not been set as search target rows. Also, the following search conditions are set: search condition 1 for searching for an index value whose difference with the last retrieved index value is less than or equal to a threshold value; and search 2 for searching for an index value that is smaller than the last retrieved index value). The TCON 60 sequentially searches the search target rows in one direction, or in other words, in order from pixel row 1 to pixel row 11, and sets the order of writing based on the order in which the pixel rows were retrieved.

In the second search processing, the TCON 60 sets rows for which the order of writing has not been set as search target rows. As a search condition, search condition 3 for searching for an index value that is greater than the last retrieved index value is set. The TCON 60 sequentially searches the search target rows in one direction, or in other words, in order from pixel row 1 to pixel row 11, and sets the order of writing based on the order in which the pixel rows were retrieved.

To be specific, in FIG. 21, the threshold value is set to 10.

In the first search processing, all of pixel rows 1 to 11 are set as search target rows. First, pixel row 1 is retrieved. Next, an index value of 17, which is the index value of pixel row 2, whose difference with an index value of 23, which is the index value of pixel row 1, is smaller than 10 is retrieved. Next, an index value of 15, which is the index value of pixel row 7, whose difference with an index value of 17, which is the index value of pixel row 2, is smaller than 10 is retrieved. The index values of pixel rows 3, 4 and 6 are not retrieved because the difference is greater than 10. Also, an index value of 19, which is the index value of pixel row 5, is not retrieved because it is greater than an index value of 17, which is the index value of pixel row 2. Likewise, an index value of 7, which is the index value of pixel row 9, and an index value of 2, which is the index value of pixel row 11, are retrieved. The order of writing is set for the retrieved pixel rows 1, 2, 7, 9 and 11 based on this order.

The second search processing is then executed. In the second search processing, pixel rows 3 to 6, 8 and 10 for which the order of writing has not been set are set as search target rows. First, pixel row 3 is retrieved, and then pixel row 4 having an index value of 5, which is greater than an index value of 1, which is the index value of pixel row 3, is retrieved. Likewise, an index value of 19, which is the index value of pixel row 5, and an index value of 29, which is the index value of pixel row 8, are retrieved. The order of writing is set for the retrieved pixel rows 3, 4, 5 and 8 based on this order.

Finally, pixel row 6 and pixel row 10 for which the order of writing has not been set are retrieved, and the order of writing is set based on this order.

In short, in the present variation, the order of writing is set in the order of pixel row 1, 2, 7, 9, 11, 3, 4, 5, 8, 6 and 10.

According to the present variation as well, the difference in output voltage of the source driver IC 20 can be reduced.

The guidance for sorting the order of writing to the pixel rows may be implemented by setting representative values of the pixels of each pixel row (the pixels having values from the maximum value to the 64th value, the pixels having values from the minimum value to the 64th value, the pixels located in 64 pixel rows, etc.), comparing the representative values, and sorting the representative values so as to minimize each index value difference for all rows.

Also, in the organic EL panel, the light emission efficiency varies depending on the emitted color such as red (R), green (G) or blue (B). Also, the required voltage amplitude also varies. Accordingly, the index value is preferably obtained through computation separately by division according to the color such as red (R), green (G) and blue (B).

It will be appreciated that the foregoing description is applicable to other embodiments disclosed in the present specification. It will also be appreciated that it can be combined with other embodiments disclosed in the present specification.

[1-7. Variation 4: Another Example 2 of Method of Sorting Order of Writing]

Variation 4 will be described with reference to FIG. 22.

Figure 22:
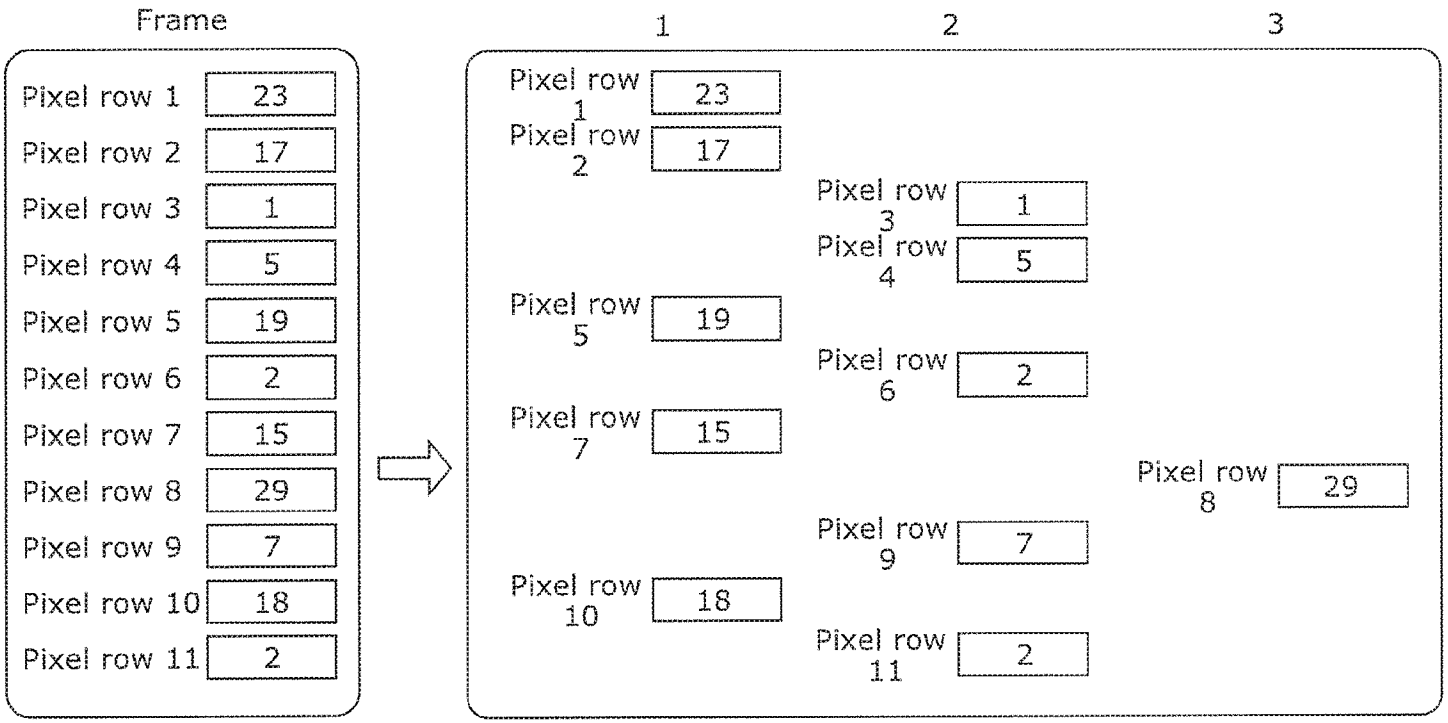
FIG. 22 is a diagram showing an example of a method of sorting the order of writing according to Variation 4.

FIG. 22 is a diagram showing an example of a method of sorting the order of writing according to the present variation.

In the present variation, the TCON 60 executes the first search processing of Variation 3. The search condition 2 is not used. First search processing according to the present variation is configured by omitting the search condition 2 from the first search processing of Variation 3. That is, as a search condition, search condition 1 for searching for an index value whose difference with the last retrieved index value is less than or equal to a threshold value is set. In the present variation, the first search processing is repeatedly executed until there are no more search target rows.

Also, the TCON 60 sequentially searches the search target rows in one direction, or in other words, in order from pixel row 1 to 11, and sets the order of writing based on the order in which the rows were retrieved.

To be specific, in FIG. 22, the threshold value is set to 7.

In the first instance of the first search processing, pixel rows 1 to 11 are set as search target rows. First, pixel row 1 is retrieved. Next, an index value of 17, which is the index value of pixel row 2, whose difference with an index value of 23, which is the index value of pixel row 1, is smaller than 7 is retrieved. Next, an index value of 19, which is the index value of pixel row 5, whose difference with an index value of 17, which is the index value of pixel row 2, is smaller than 7 is retrieved. The index values of pixel rows 3 and 4 are not retrieved because the difference is greater than 7. Likewise, an index value 15, which is the index value of pixel row 7, and an index value 18, which is the index value of pixel row 10, are retrieved. The order of writing is set for the retrieved pixel rows 1, 2, 5, 7 and 10 based on this order.

In the second instance of the first search processing, pixel rows 3, 4, 6, 8, 9 and 11 are set as search target rows. First, pixel row 3 is retrieved. Next, an index value of 5, which is the index value of pixel row 4, whose difference with an index value of 1, which is the index value of pixel row 3, is smaller than 7 is retrieved. Likewise, an index value of 2, which is the index value of pixel row 6, an index value of 7, which is the index value of pixel row 9, and an index value of 2, which is the index value of pixel row 11, are retrieved. The order of writing is set for the retrieved pixel rows 3, 4, 6, 9 and 11 based on this order.

In the third instance of the first search processing, pixel row 8 is set as a search target row. Pixel row 8 is added in the order of writing.

In short, in the present variation, the order of writing is set in the order of pixel row 1, 2, 5, 7, 10, 3, 4, 6, 9, 11 and 8.

According to the present variation as well, the difference in output voltage of the source driver IC 20 can be reduced.

[1-8. Variation 5: Another Example of Index Value Calculation]

Variation 5 will be described with reference to FIG. 23.

The present variation is different from the embodiment and Variations 1 to 4 described above in terms of the method of calculating an index value that indicates the brightness level of each row. In the embodiment and Variations 1 to 4 described above, as the index value, a total value of squared voltage signals ($=\Sigma_{k=1}$ to m $(\mathrm{Luma}(k))^2$, where k represents an integer, m represents the number of pixels included in one row, and Luma(k) represents a voltage value indicated by the voltage signal of the corresponding display pixel P1 in k row) is obtained.

In contrast, in the present variation, as the index value, a total value of squared difference of voltage signals ($=\Sigma_{k=1}$ to m $\{(\mathrm{Luma}(i)(k))^2-(\mathrm{Luma}(j)(k))^2\}$ (where i and j represent pixel rows, i=1 to n−1, and j=i+1) is obtained. This is obtained, for example, between pixel row 1 and each of pixel rows 2 to m, between pixel row 2 and each of pixel rows 3 to m, . . . , and between pixel row m-1 and pixel row m. The index value of the present variation indicates the difference in brightness between two rows, or in other words, relative brightness level of a row with respect to that of another row.

FIG. 23 is a diagram showing an example of a method of sorting the order of writing according to the present variation.

For the first column, $17^2-1^2=288$. The same processing is performed until the m-th column, and a total of the obtained values is used as the index value.

The search method may be set in accordance with the embodiment and Variations 1 to 4. For example, the TCON 60 first selects pixel row 1, and then retrieves a pixel row having an index value whose difference with the index value of pixel row 1 is less than or equal to a threshold value (corresponding to Variations 3, 4 and the like), or a pixel row having an index value whose difference with the index value of pixel row 1 is the smallest (corresponding to the embodiment and Variations 1, 2 and the like), or the like. Likewise, the TCON 60 sequentially retrieves pixel rows having an index value whose difference with the index value of the last retrieved pixel row is less than or equal to a threshold value or the smallest.

According to the present variation as well, the difference in output voltage of the source driver IC 20 can be reduced.

[1-9. Variation 6: Another Example of Configuration of Display Pixel]

Variation 6 will be described with reference to FIG. 24. The present variation is different from the embodiment and Variations 1 to 4 described above in terms of the configuration of the display pixel P.

Figure 24:
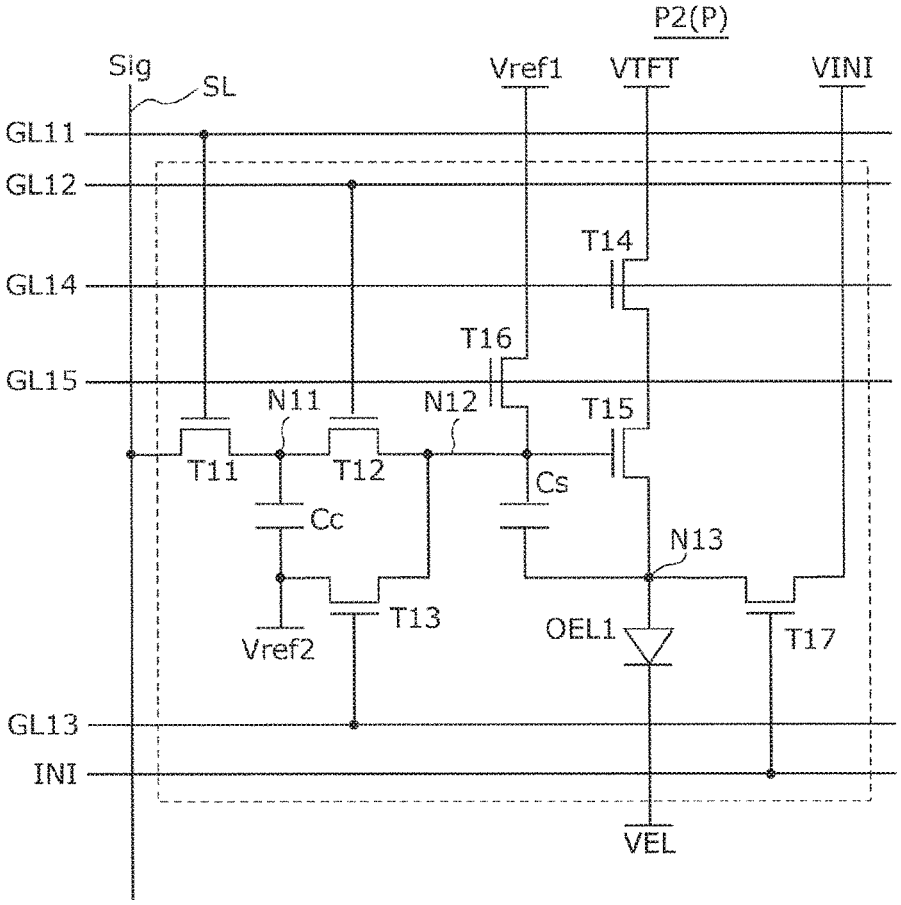
FIG. 24 is a circuit diagram showing an example of a configuration of a display pixel according to Variation 6.

FIG. 24 is a circuit diagram showing an example of a configuration of a display pixel P2 (P) according to the present variation.

As shown in FIG. 24, the display pixel P2 includes switching elements T11 to T14, T16 and T17, capacitors Cc and Cs, a driving transistor T15 and an organic EL element (light emitting element) OEL1.

The switching element T11 is an example of a first switch circuit that performs switching between selection and deselection of the display pixel P2, and is composed of an N-channel type MOS transistor. The switching element T11 performs switching between conduction and non-conduction between a source signal line SL and an node N11 according to the selection signal applied to a gate signal line GL11.

The switching elements T12 to T14, T16 and T17 are N-channel type MOS transistors. With the switching elements T12 to T14, T16 and T17, a writing operation of writing the voltage signal into the capacitor Cc, a reset operation of resetting the capacitor Cs, a copy operation of copying the voltage signal written into the capacitor Cc to the capacitor Cs, and a light emitting operation of performing light emission of the organic EL element OEL1 can be performed.

The switching element T12 is an example of a second switch circuit that performs switching between connection and disconnection between the capacitor Cc and the capacitor Cs, and performs switching between conduction and non-conduction between the node N11 and an node N12 according to the signal applied to a gate signal line GL12.

The switching element T13 switches whether or not to input a voltage Vref2 to the node N12 according to the signal applied to a gate signal line GL13. The voltage Vref2 is a voltage for initializing the capacitor Cc.

The switching element T14 is an example of a third switch circuit that performs switching between connection and disconnection between the driving transistor T15 and the organic EL element OEL1, and performs switching between supply and non-supply of driving current to the organic EL element OEL1 by the driving transistor T15 according to the signal applied to a gate signal line GL14.

The switching element T16 switches whether or not to input a voltage Vref1 to the node N12 according to the signal applied to a gate signal line GL15. The voltage Vref1 is a voltage for initializing the capacitor Cs.

The switching element T17 switches whether or not to apply a voltage VINI to an node N13 according to the signal applied to a gate signal line INI. The voltage VINI is a voltage for initializing the organic EL element OEL1.

The driving transistor T15 is composed of an N-channel type MOS transistor, and supplies, to the organic EL element OEL1, a driving current corresponding to the magnitude of the voltage signal written into the capacitor Cs. The driving transistor T15 includes a gate terminal connected to the node N12, a drain terminal connected to the anode electrode of the organic EL element OEL1, and a source terminal that receives an input of voltage VTFT via the switching element T14.

The organic EL element OEL1 is an element that emits light according to the driving current supplied from the driving transistor T15. The organic EL element OEL1 includes a cathode electrode that receives an input of voltage VEL and an anode electrode connected to the switching element T14.

The capacitor Cc is a capacitor into which the voltage signal is written by the source driver IC 20, and includes one end connected to the node N11 and the other end that receives an input of voltage Vref1.

The capacitor Cs is a capacitor into which the voltage signal of the capacitor Cc is copied (the capacitor that receives the electric charge in the capacitor Cc), and includes one end connected to the node N12 and the other end that receives an input of voltage VTFT.

With the configuration described above, the display pixel P2 can perform writing of the voltage signal and light emission of the organic EL element in an independent manner.

According to the present variation as well, by sorting the order of writing by using any one of the methods according to the embodiment and Variations 1 to 5, the difference in output voltage of the source driver IC 20 can be reduced.

Also, by using the display pixel P2 of the present variation, the lowering of the image quality can be prevented.

(Other Embodiments)

Up to here, the organic EL display (display apparatus) according to the embodiment has been described, but the present disclosure is not limited to the embodiment described above. Other embodiments obtained by making various modifications conceived by a person skilled in the art to the present embodiment, as well as embodiments implemented by any combination of the structural elements of different embodiments are also encompassed within one or more aspects of the present disclosure without departing from the scope of the present disclosure.

(1) As the index value indicating the brightness level of each of the rows of a plurality of display pixels, a total value of squared luminance values is obtained in the embodiment and Variations 1 to 4 and 6 described above, and a total value of squared difference of voltage signals is obtained in Variation 5. However, the present disclosure is not limited thereto. The index value may be, for example, an average value of the pixels included in one row, a squared average value or the like.

(2) In the embodiment and Variation 1, the index value is sorted in descending order or in ascending order, and in Variation 2, a determination is made as to whether to sort the index value in descending order or in ascending order for each field or frame. However, the present disclosure is not limited thereto.

It is also possible to, for each field or frame, set in advance a pattern that specifies whether to sort the index value in ascending order or in descending order.

To be specific, for example, it is generally assumed that the difference between minimum values or the difference between maximum values is the smallest. For this reason, whether to sort the index value in descending order or in ascending order may be set alternately for each field or frame.

INDUSTRIAL APPLICABILITY

The present disclosure is applicable to a display apparatus such as an organic EL display that uses an organic electroluminescent (EL) element.

The invention claimed is:

1. A display apparatus comprising:

a display unit including a plurality of gate signal lines arranged in rows, a plurality of source signal lines arranged in columns, and a plurality of display pixels disposed at intersections of the plurality of gate signal lines and the plurality of source signal lines;

a gate driver capable of selecting the plurality of gate signal lines based on a designated order;

a source driver that outputs a voltage signal to each of the plurality of source signal lines; and a control unit configured to control the plurality of display pixels, the gate driver and the source driver, wherein each of the plurality of display pixels includes: a light emitting element that emits light according to a driving current; a write capacitor into which the voltage signal is written; a display capacitor capable of receiving an electric charge of the write capacitor; and a driving transistor that supplies, to the light emitting element, the driving current corresponding to a magnitude of the electric charge stored in the display capacitor, each of the plurality of display pixels being capable of independently executing writing of the voltage signal into the write capacitor and light emission of the light emitting element according to the electric charge stored in the display capacitor, the control unit is configured to execute sort processing of sorting an order of writing to the rows of the display unit so as to reduce a difference in the voltage signal between two successive rows in the order of writing, the control unit is configured to designate the order of writing so as to cause the gate driver to select the plurality of gate signal lines based on the order of writing after the sort processing has been executed by the control unit, the control unit is configured to, in the sort processing, calculate an index value indicating a brightness level of each of the rows of the plurality of display pixels, and sort the order of writing by using the index value, and the control unit is configured to obtain, as the index value, a total value obtained by obtaining a squared voltage signal for each of the plurality of display pixels and summing the squared voltage signals for each of the rows, the squared voltage signals each being a square of the voltage signal.

2. The display apparatus according to claim 1, wherein the control unit is configured to, in the sort processing, sort the index value in descending order or in ascending order, and set the order of writing based on the order in which the index values were sorted.

3. The display apparatus according to claim 2, wherein the control unit is configured to, in the sort processing, obtain minimum and maximum index values, which are minimum and maximum of the index value, in a current instance of the sort processing, compare a final index value, which is an index value of a last row in the order of writing in a previous instance of the sort processing, with the minimum and maximum index values, sort the index value in ascending order when a difference between the final index value and the minimum index value is smaller than a difference between the final index value and the maximum index value, and sort the index value in descending order when the difference between the final index value and the minimum index value is smaller than the difference between the final index value and the minimum index value.

4. The display apparatus according to claim 1, wherein the control unit is configured to, in the sort processing, execute first search processing of setting rows for which the order of writing has not been set as search target rows, sequentially searching the search target rows in one direction so as to retrieve rows by using a search condition that defines the rows having the index value whose difference with the index value of a last retrieved row is less than or equal to a threshold value, and setting the order of writing based on the order in which the rows were retrieved.

5. The display apparatus according to claim 4, wherein the control unit is configured to, after execution of the first search processing, execute second search processing of further setting rows for which the order of writing has not been set as search target rows, searching the search target rows in the one direction so as to retrieve search target rows whose index value is greater or smaller than the index value of a last retrieved search target row, and setting the order of writing based on the order in which the search target rows were retrieved.

6. The display apparatus according to claim 1, wherein each of the plurality of display pixels further includes:

a first switch circuit that performs switching between selection and deselection of the each of the plurality of display pixels;

a second switch circuit that performs switching between connection and disconnection between the write capacitor and the display capacitor; and a third switch circuit that performs switching between connection and disconnection between the driving transistor and the light emitting element.

7. The display apparatus according to claim 6, wherein in writing processing of writing the voltage signal, the gate driver disconnects the second switch circuit so as to make the write capacitor and the display capacitor independent of each other, selects the first switch circuit so as to write the voltage signal into the write capacitor, and connects the third switch circuit so as to cause the light emitting element to emit light, and in copy processing of copying the voltage signal from the write capacitor to the display capacitor, the gate driver deselects the first switch circuit and disconnects the third switch circuit so as to cause the light emitting element to stop emitting light, and connects the second switch circuit so as to write the voltage signal written in the write capacitor into the display capacitor.

8. A display method executed in a display apparatus including:

a display unit including a plurality of gate signal lines arranged in rows, a plurality of source signal lines arranged in columns, and a plurality of display pixels disposed at intersections of the plurality of gate signal lines and the plurality of source signal lines;

a gate driver capable of selecting the plurality of gate signal lines based on a designated order;

a source driver that outputs a voltage signal to each of the plurality of source signal lines; and a control unit configured to control the plurality of display pixels, the gate driver and the source driver, each of the plurality of display pixels including: a light emitting element that emits light according to a driving current; a write capacitor into which the voltage signal is written; a display capacitor capable of receiving an electric charge of the write capacitor; and a driving transistor that supplies, to the light emitting element, the driving current corresponding to a magnitude of the electric charge stored in the display capacitor, and being configured to be capable of independently executing writing of the voltage signal into the write capacitor and light emission of the light emitting element according to the electric charge stored in the display capacitor, the display method comprising: with the control unit, sorting an order of writing to the rows of the display unit so as to reduce a difference in the voltage signal between two successive rows in the order of writing;

designating the order of writing so as to cause the gate driver to select the plurality of gate signal lines based on the order of writing after the sorting has been executed;

controlling the each of the plurality of display pixels such that the display capacitor and the write capacitor are not electrically connected to each other when the plurality of gate signal lines are selected by the gate driver;

controlling the each of the plurality of display pixels such that the display capacitor and the write capacitor are electrically connected to each other when the plurality of gate signal lines are not selected by the gate driver, calculating an index value, in the sorting, indicating a brightness level of each of the rows of the plurality of display pixels, and sort the order of writing by using the index value, and obtaining, as the index value, a total value obtained by obtaining a squared voltage signal for each of the plurality of display pixels and summing the squared voltage signals for each of the rows, the squared voltage signals each being a square of the voltage signal.

* * * * *